US007766397B2

(12) United States Patent
Carabalona

(10) Patent No.: US 7,766,397 B2
(45) Date of Patent: Aug. 3, 2010

(54) ELECTROMECHANICAL ROTARY PAWL LATCH

(75) Inventor: Eric Carabalona, Kenilworth (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 11/943,350

(22) Filed: Nov. 20, 2007

(65) Prior Publication Data

US 2008/0252083 A1 Oct. 16, 2008

Related U.S. Application Data

(60) Provisional application No. 60/866,604, filed on Nov. 20, 2006.

(51) Int. Cl.
*E05C 3/16* (2006.01)

(52) U.S. Cl. ..... 292/201

(58) Field of Classification Search ..... 292/201, 292/216, DIG. 23

See application file for complete search history.

(56) References Cited

U.S. PATENT DOCUMENTS

| | | | |
|---|---|---|---|
| 2,736,186 | A | 2/1956 | Marple |
| 2,898,138 | A | 8/1959 | Van Noord |
| 2,916,319 | A | 12/1959 | Du Bois |
| 2,943,880 | A | 7/1960 | Joachim et al. |
| 3,262,725 | A | 7/1966 | Ballantyne |
| 3,332,713 | A | 7/1967 | De Claire et al. |
| 3,378,289 | A | 4/1968 | Beckman et al. |
| 3,378,291 | A | 4/1968 | Brian |
| 3,844,593 | A | 10/1974 | Slattery |
| 3,961,504 | A | 6/1976 | Sprecher |
| 4,262,830 | A | 4/1981 | Haves |
| 4,374,320 | A | 2/1983 | Barnett |
| 4,492,395 | A | 1/1985 | Yamada |
| 4,518,180 | A | 5/1985 | Kleefeldt et al. |
| 4,518,181 | A | 5/1985 | Yamada |
| 4,538,845 | A | 9/1985 | Yamada |
| 4,544,189 | A | 10/1985 | Fiordellisi et al. |
| 4,569,544 | A | 2/1986 | Escaravage |
| 4,575,138 | A | 3/1986 | Nakamura et al. |
| 4,597,598 | A | 7/1986 | Bascou |
| 4,667,991 | A | 5/1987 | Pèbre |
| 4,671,548 | A | 6/1987 | Häberle et al. |
| 4,703,960 | A | 11/1987 | Lense |
| 4,707,007 | A | 11/1987 | Inoh |
| 4,739,585 | A | 4/1988 | Pickles |
| 4,746,153 | A | 5/1988 | Compeau et al. |
| 4,763,936 | A | 8/1988 | Rogakos et al. |
| 4,796,932 | A | 1/1989 | Tame |
| 4,848,809 | A | 7/1989 | Escaravage |
| 4,851,742 | A | 7/1989 | Chapman |
| 4,861,089 | A | 8/1989 | Compeau et al. |
| 4,875,723 | A | 10/1989 | Compeau et al. |
| 4,889,371 | A | 12/1989 | Girard et al. |

(Continued)

FOREIGN PATENT DOCUMENTS

| | | |
|---|---|---|
| DE | 1505721 | 7/1970 |

(Continued)

*Primary Examiner*—Peter M. Cuomo
*Assistant Examiner*—Mark Williams
(74) *Attorney, Agent, or Firm*—Paul & Paul

(57) ABSTRACT

The present invention is directed to improvements in latch design. The illustrated embodiment of the present invention is a rotary pawl latch with the capability to provide a compressive force between the first member and the second member.

7 Claims, 61 Drawing Sheets

U.S. PATENT DOCUMENTS 4,892,340 A 1/1990 Matumoto
4,896,906 A 1/1990 Weinerman et al.
4,906,035 A 3/1990 Nagai et al.
4,927,196 A 5/1990 Girard et al.
4,968,073 A 11/1990 Kuhlman
4,969,672 A 11/1990 Childs et al.
4,974,885 A 12/1990 Yokoyama
4,976,477 A 12/1990 Nakao
4,976,478 A 12/1990 Acciacca et al.
4,982,984 A 1/1991 Yokota et al.
4,998,049 A 3/1991 Chapman
5,007,261 A 4/1991 Quantz
5,020,838 A 6/1991 Fukumoto
5,033,789 A 7/1991 Hayashi et al.
5,069,491 A 12/1991 Weinerman et al.
5,163,723 A 11/1992 Rückert
5,172,947 A 12/1992 Schap
5,180,198 A 1/1993 Nakamura et al.
5,222,775 A 6/1993 Kato
5,232,253 A 8/1993 Tamiya
5,273,325 A 12/1993 Zimmermann
5,299,844 A 4/1994 Gleason
5,411,302 A 5/1995 Shimada
5,429,400 A 7/1995 Kawaguchi et al.
5,439,260 A 8/1995 Weinerman et al.
5,443,292 A 8/1995 Shimada et al.
5,445,326 A 8/1995 Ferro et al.
5,498,040 A 3/1996 Silye
5,549,337 A 8/1996 McCulloch
5,564,295 A 10/1996 Weinerman et al.
5,586,458 A 12/1996 Weinerman et al.
5,595,409 A 1/1997 Fier et al.
5,611,224 A 3/1997 Weinermann et al.
5,620,226 A 4/1997 Sautter, Jr.
5,632,515 A 5/1997 Dowling
5,634,677 A 6/1997 Büscher et al.
5,639,130 A 6/1997 Rogers, Jr. et al.
5,642,636 A 7/1997 Mitsui
5,765,884 A 6/1998 Armbruster
5,769,468 A 6/1998 Armbruster
5,816,628 A 10/1998 Götzen et al.
5,868,444 A * 2/1999 Brackmann et al. ..... 292/201
5,884,948 A 3/1999 Weinerman et al.
5,909,918 A 6/1999 Kowalewski et al.
5,931,290 A 8/1999 Wehrli, III et al.
5,934,717 A 8/1999 Wirths et al.
5,961,163 A 10/1999 Brackmann et al.
5,992,194 A 11/1999 Baukholt et al.
5,997,054 A 12/1999 Baudu et al.
6,053,543 A 4/2000 Arabia, Jr. et al.
6,059,327 A 5/2000 Yoshikuwa
6,067,869 A 5/2000 Chilla et al.
6,076,868 A 6/2000 Roger, Jr. et al.
6,113,161 A 9/2000 Jung et al.
6,116,664 A 9/2000 Wegner
6,158,786 A 12/2000 Droste et al.
6,176,528 B1 1/2001 Taga
6,216,980 B1 4/2001 Baudu et al.
6,223,468 B1 5/2001 Kobayashi
6,338,508 B1 1/2002 Kleefeldt
6,341,807 B2 1/2002 Cetnar et al.
6,386,599 B1 5/2002 Chevalier
6,394,511 B1 5/2002 Lam et al.
6,422,615 B1 7/2002 Roos et al.
6,427,505 B2 8/2002 Imedio Ocana
6,471,260 B1 10/2002 Weinerman et al.
6,505,867 B1 1/2003 Szablewski et al.
6,510,656 B1 1/2003 Fukumoto et al.
6,511,107 B2 1/2003 Barczynski et al.
6,557,911 B2 5/2003 Nelsen et al.
6,575,507 B2 6/2003 Reddmann
6,648,379 B1 11/2003 Kordowski et al.
6,651,467 B1 11/2003 Weinerman et al.
6,666,482 B2 12/2003 Hansen et al.
6,712,407 B2 3/2004 Duriez
6,719,333 B2 4/2004 Rice et al.
6,776,442 B2 8/2004 Edgar
6,832,793 B2 12/2004 Bingle et al.
6,863,317 B2 3/2005 Alton et al.
6,863,318 B2 3/2005 Mejean et al.
6,886,869 B2 5/2005 Martinez et al.
6,948,745 B2 9/2005 Chevalier
6,971,967 B2 12/2005 Whitmarsh
6,988,749 B2 1/2006 Hashiba et al.
6,997,488 B2 * 2/2006 Kurten et al. ..... 292/201
7,029,040 B2 4/2006 Lippoldt et al.
7,032,938 B2 4/2006 Kachouh
7,036,853 B2 5/2006 Smock et al.
7,040,673 B2 5/2006 Smock et al.
7,089,948 B2 8/2006 DeBoer et al.
7,128,361 B2 10/2006 Guillez et al.
7,156,430 B2 1/2007 Hidding et al.
7,192,066 B2 * 3/2007 Ilea et al. ..... 292/201
2001/0024041 A1 9/2001 Barczynski et al.
2001/0052705 A1 12/2001 Fisher
2003/0111863 A1 6/2003 Weyerstall et al.
2005/0134054 A1 * 6/2005 Stefanic et al. ..... 292/201
2005/0200137 A1 * 9/2005 Nelsen et al. ..... 292/201

FOREIGN PATENT DOCUMENTS

DE 3333746 6/1985
DE 10009370 9/2001
EP 0408951 1/1991
FR 2807778 A1 10/2001
FR 2860023 3/2005

* cited by examiner

Fig. 44
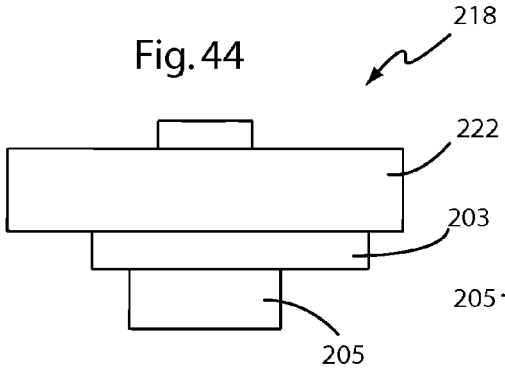
Fig. 42
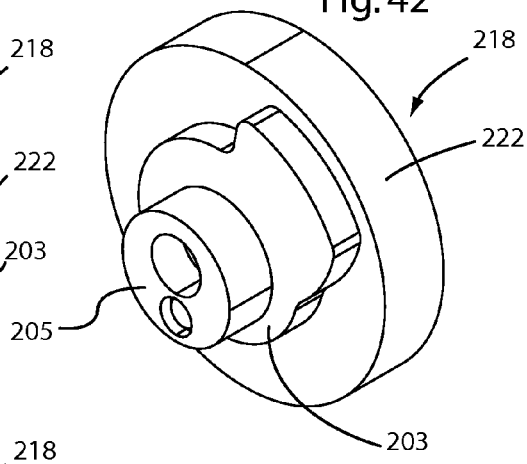
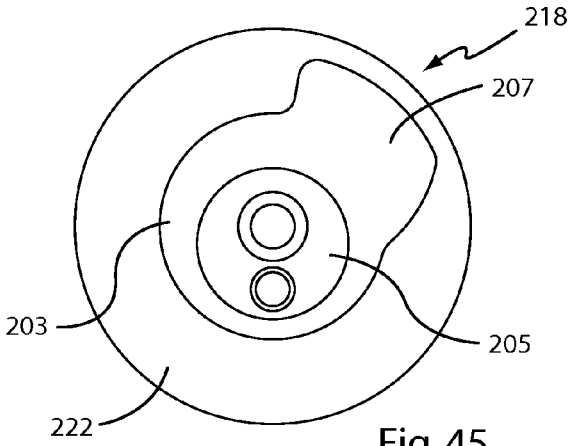
Fig. 45
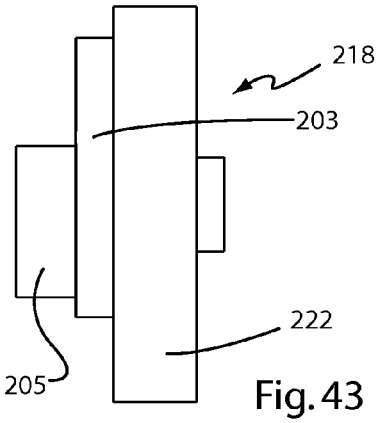
Fig. 43
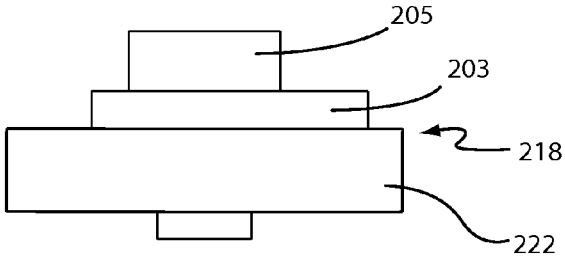
Fig. 46

ELECTROMECHANICAL ROTARY PAWL LATCH

This application claims the benefit of the priority of U.S. Provisional Application for Patent Ser. No. 60/866,604, filed on Nov. 20, 2006, the entirety of which is incorporated herein by reference.

BACKGROUND OF THE INVENTION

1. Field of the Invention

The present invention relates to a latch for releasably securing a first member, such as a door, panel or the like, relative to a second member.

2. Description of the Prior Art

Latches are used to releasably secure panels, covers, doors, electronic modules, and the like to other structures such as compartments, cabinets, containers, doorframes, other panels, frames, racks, etc. Although many latch designs are known in the art, none offers the advantages of the present invention. The advantages of the present invention will be apparent from the attached detailed description and drawings.

SUMMARY OF THE INVENTION

The present invention is directed to improvements in latch design. The illustrated embodiment of the present invention is a rotary pawl latch with the capability to provide a compressive force between the first member and the second member.

BRIEF DESCRIPTION OF THE DRAWINGS

FIGS. 42-48 are views of the cam gear of the latch of the present invention.

DETAILED DESCRIPTION OF THE PREFERRED EMBODIMENTS

Figure 1:
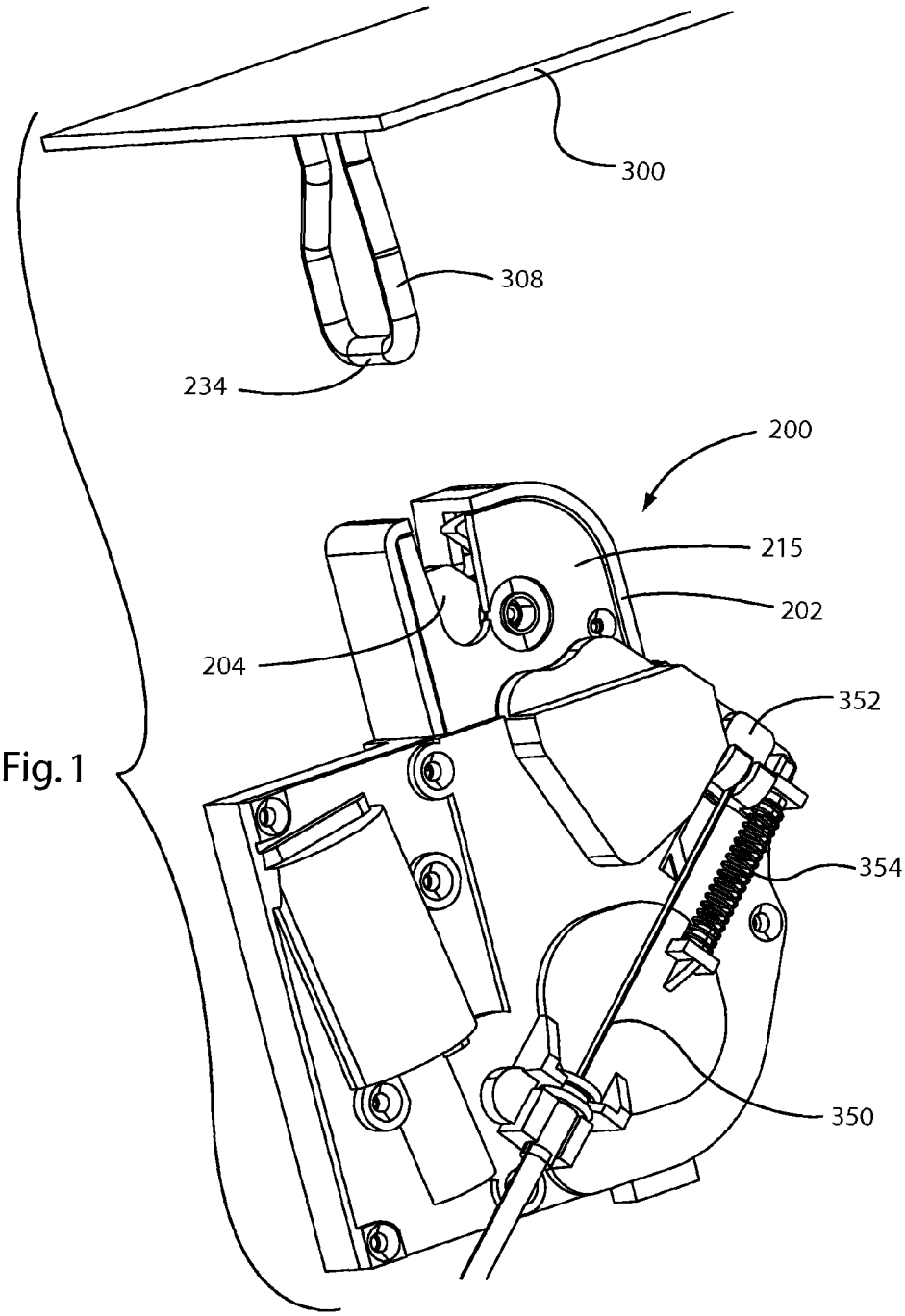
FIG. 1 is an environmental view of the latch of the present invention showing the latch in relation to a trunk lid having a striker with the striker completely disengaged from the latch.
Figure 2:
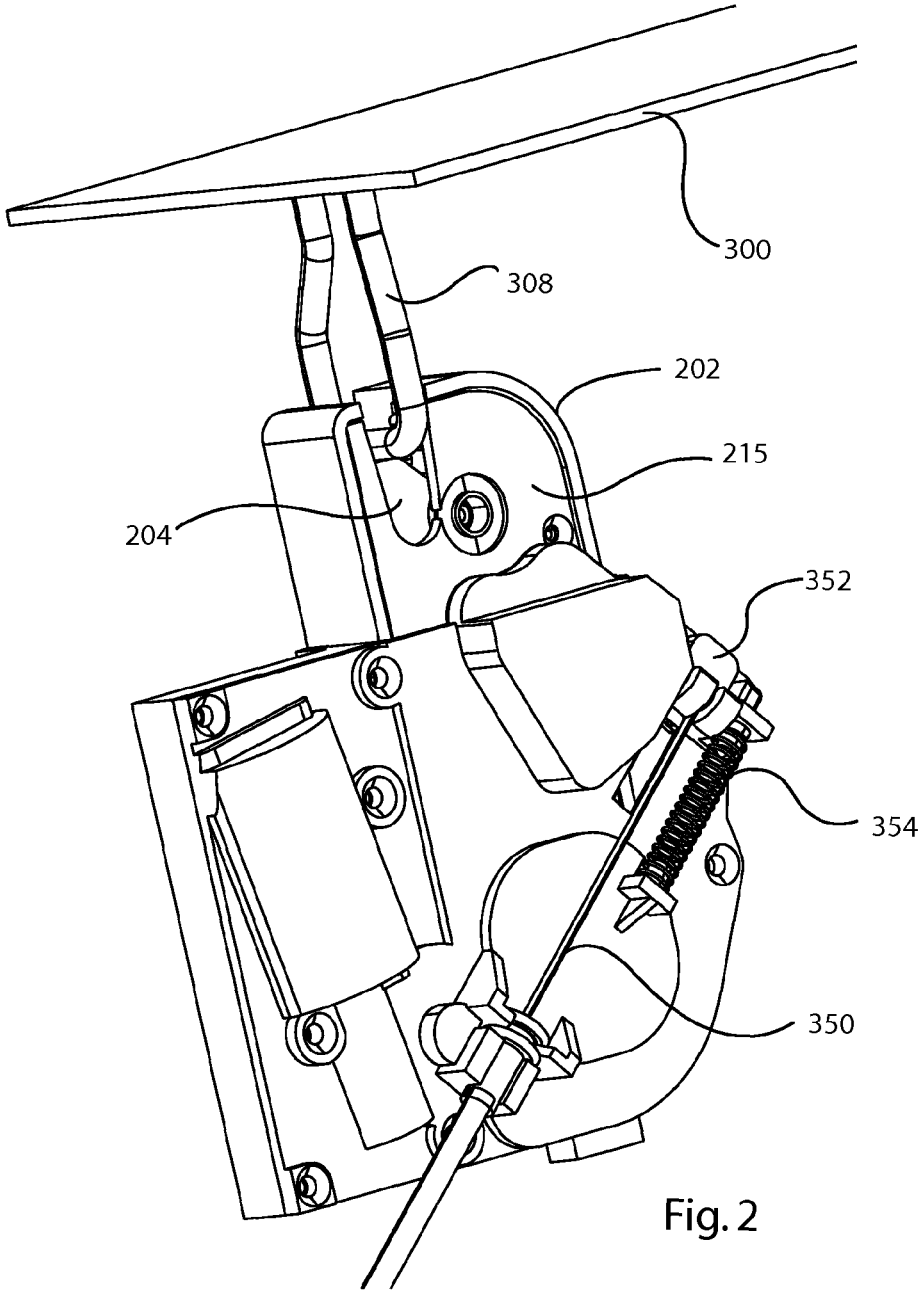
FIG. 2 is an environmental view of the latch of the present invention showing the latch in relation to a trunk lid having a striker shown in contact with the pawl with the latch in the fully unlatched configuration.
Figure 3:
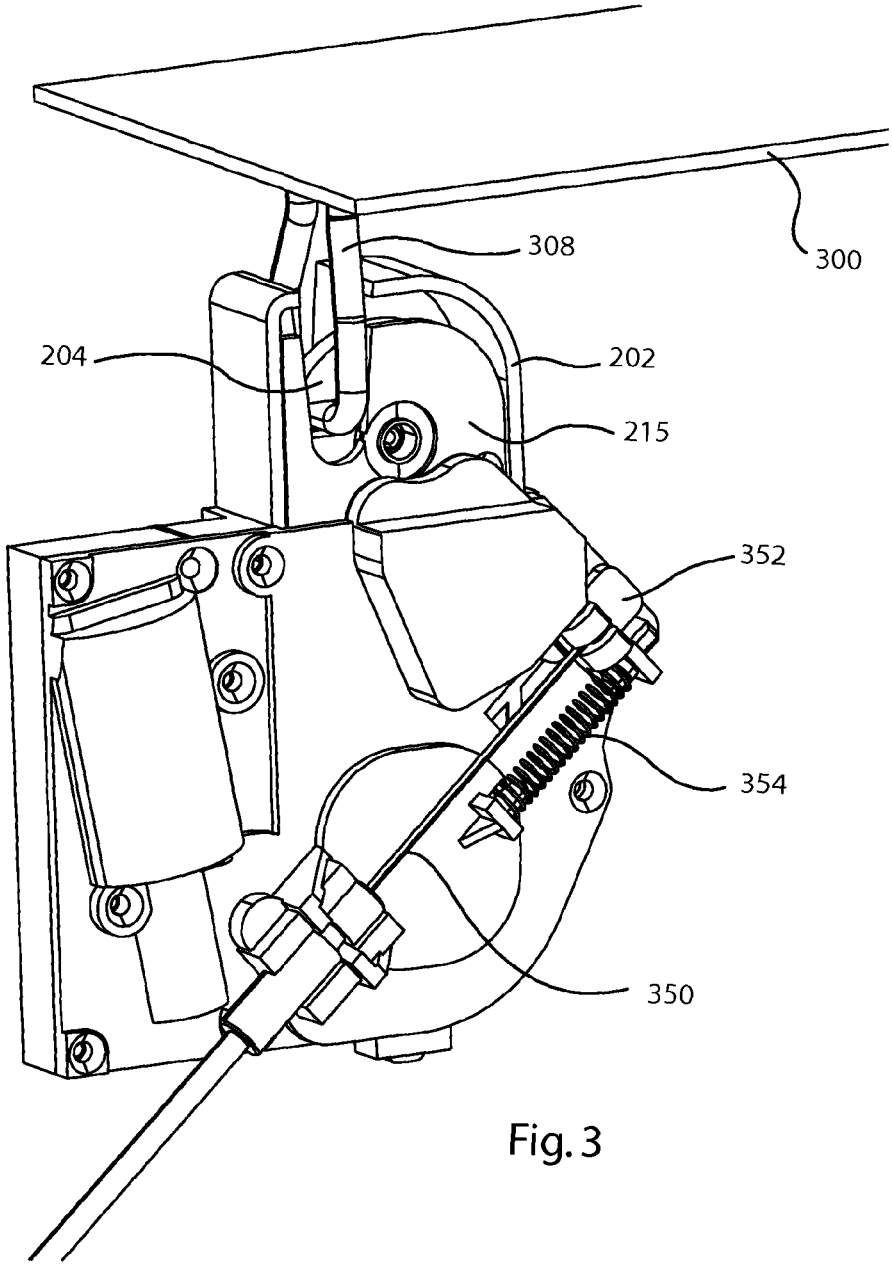
FIG. 3 is an environmental view of the latch of the present invention in isometric perspective showing the latch in relation to a trunk lid having a striker shown captured by the pawl.
Figure 4:
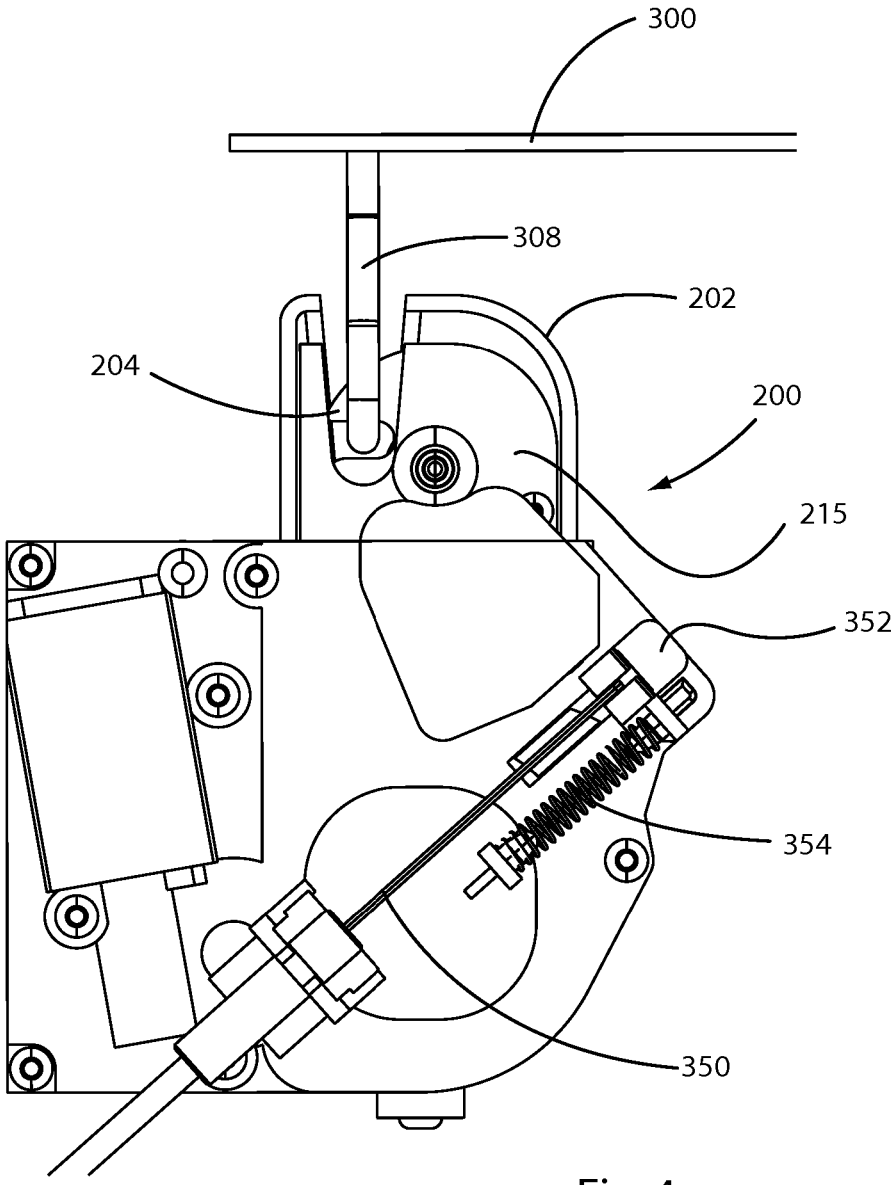
FIG. 4 is an environmental view of the latch of the present invention in side elevation showing the latch in relation to a trunk lid having a striker shown captured by the pawl.
Figure 5:
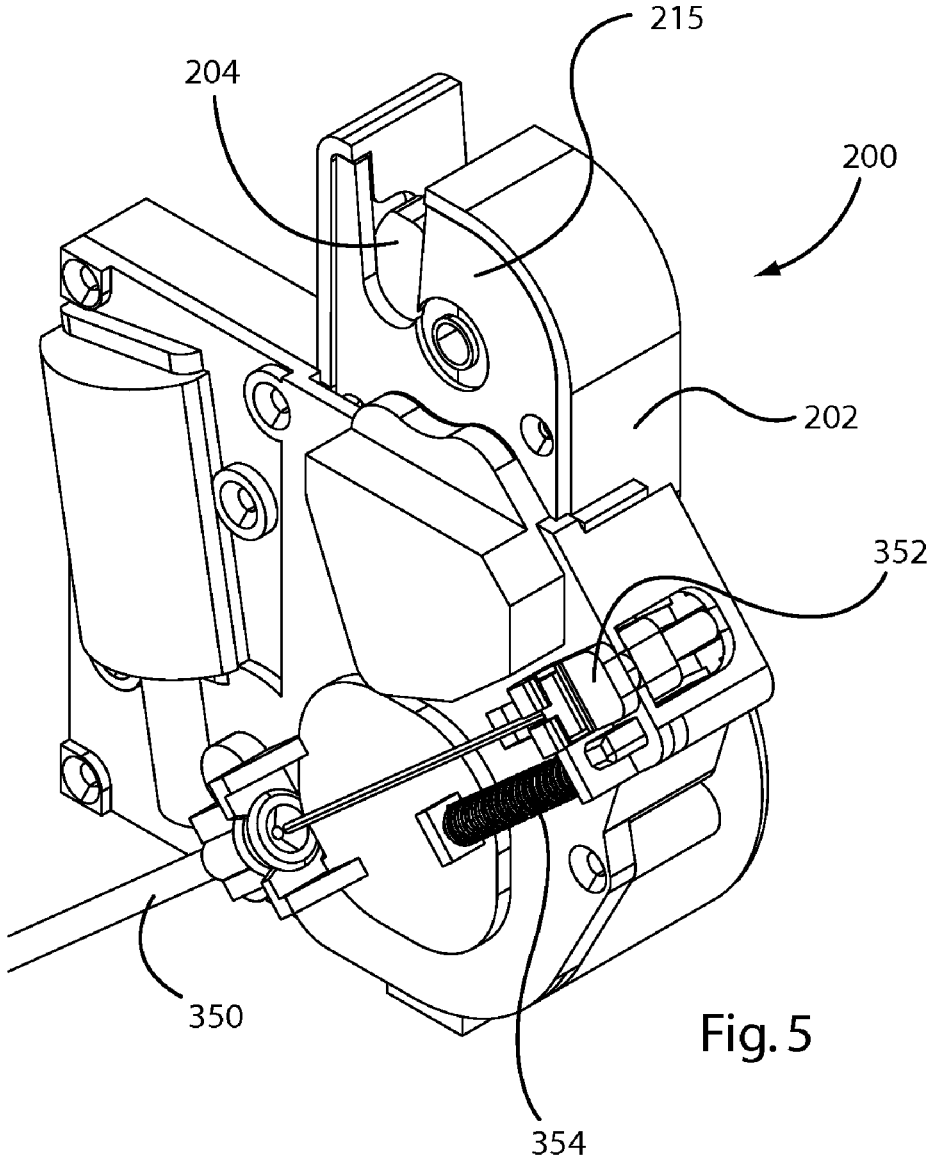
FIG. 5 is an isometric view of the latch of the present invention showing the latch in the fully unlatched configuration.
Figure 6:
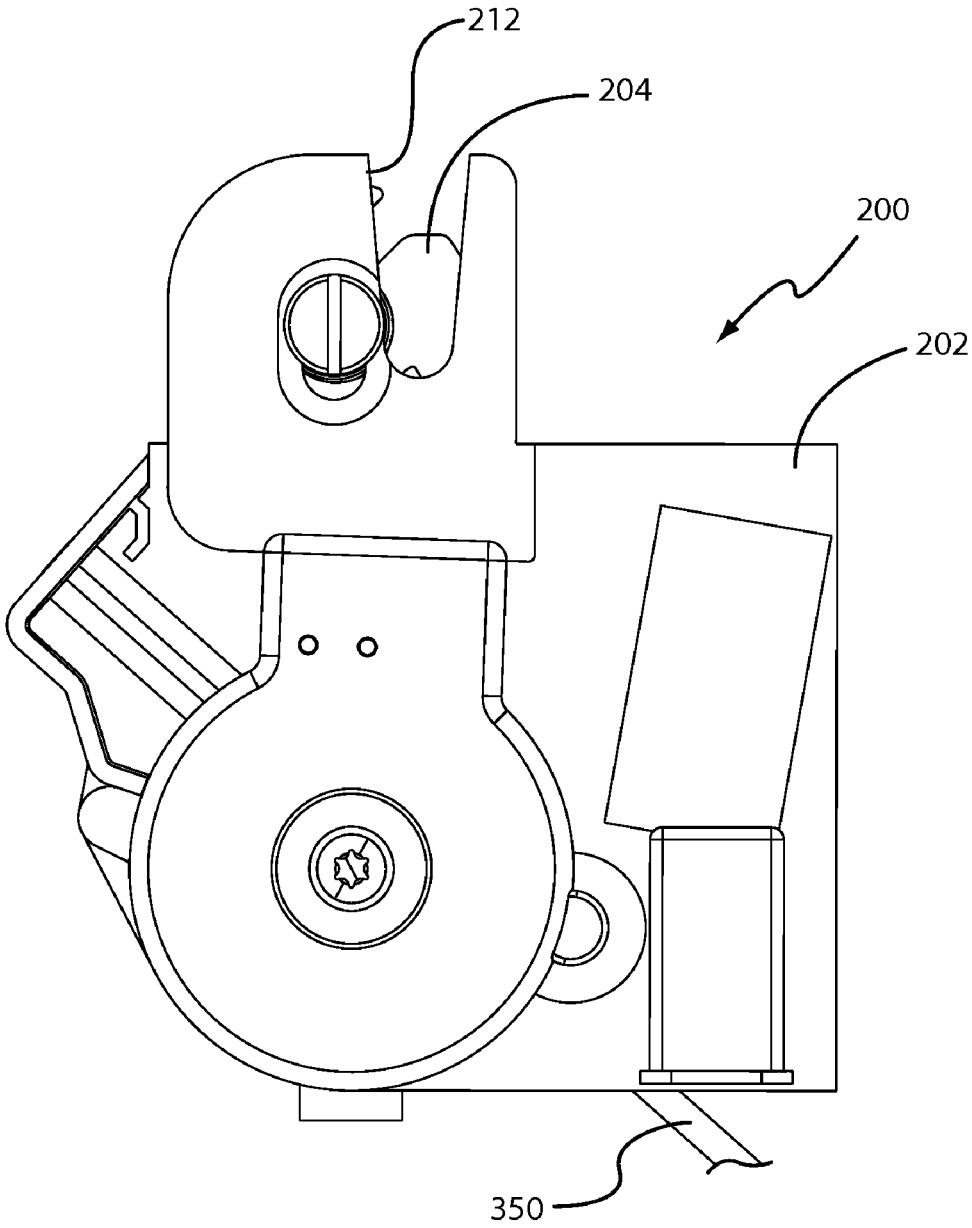
FIGS. 6 and 7 are elevational views of the latch of the present invention from opposite sides showing the latch in the fully unlatched configuration.
Figure 7:
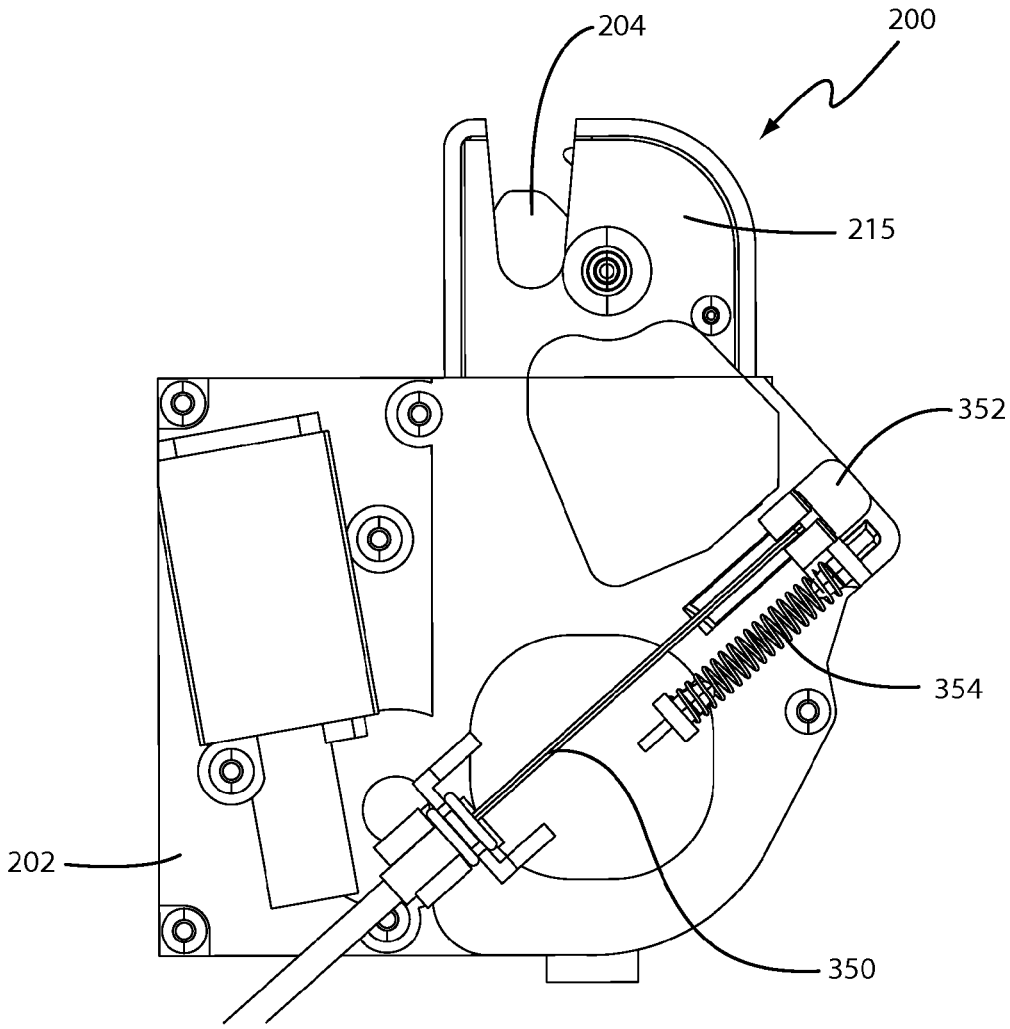
Figure 8:
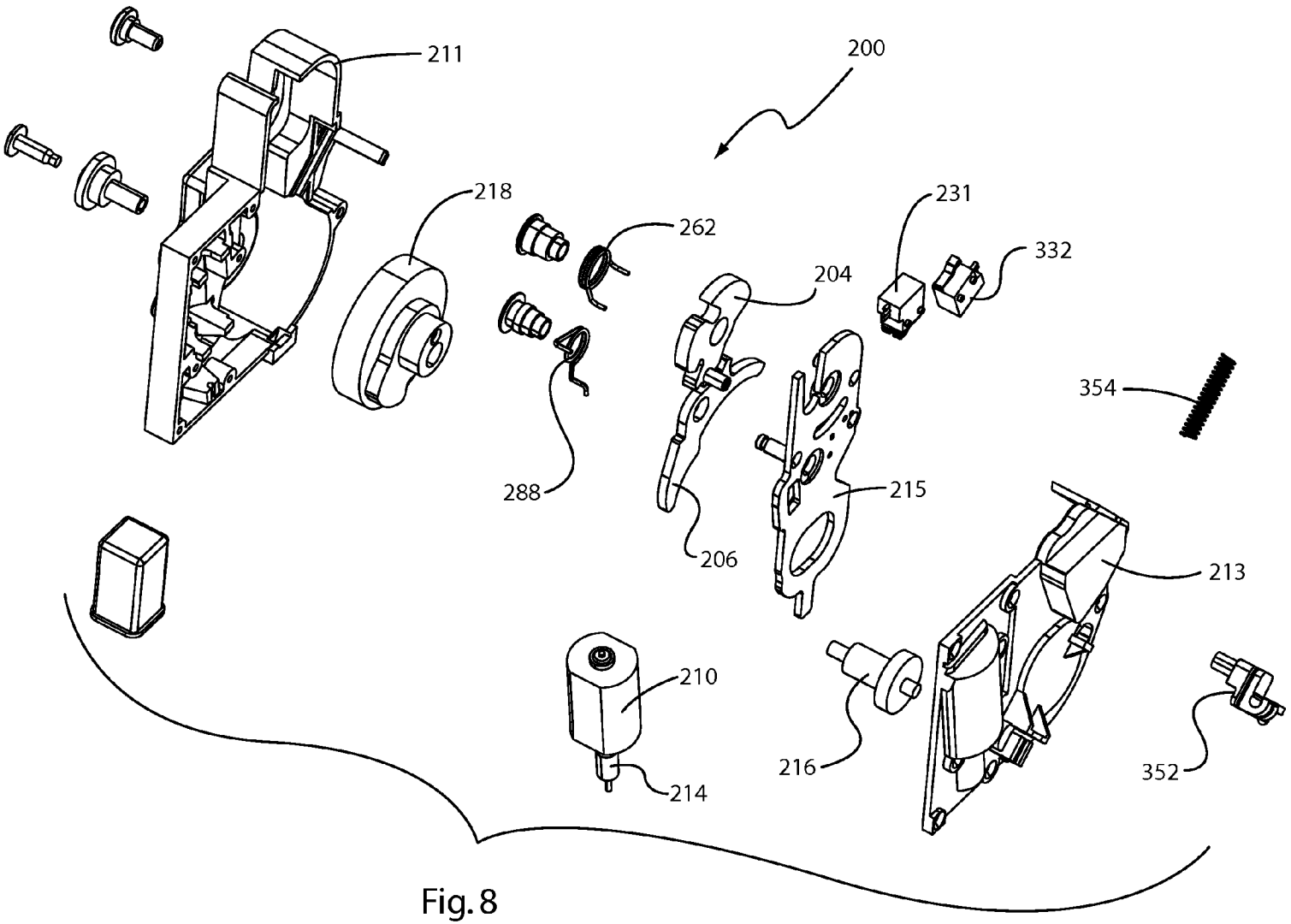
FIG. 8 is an exploded view of the latch of the present invention.
Figure 9:
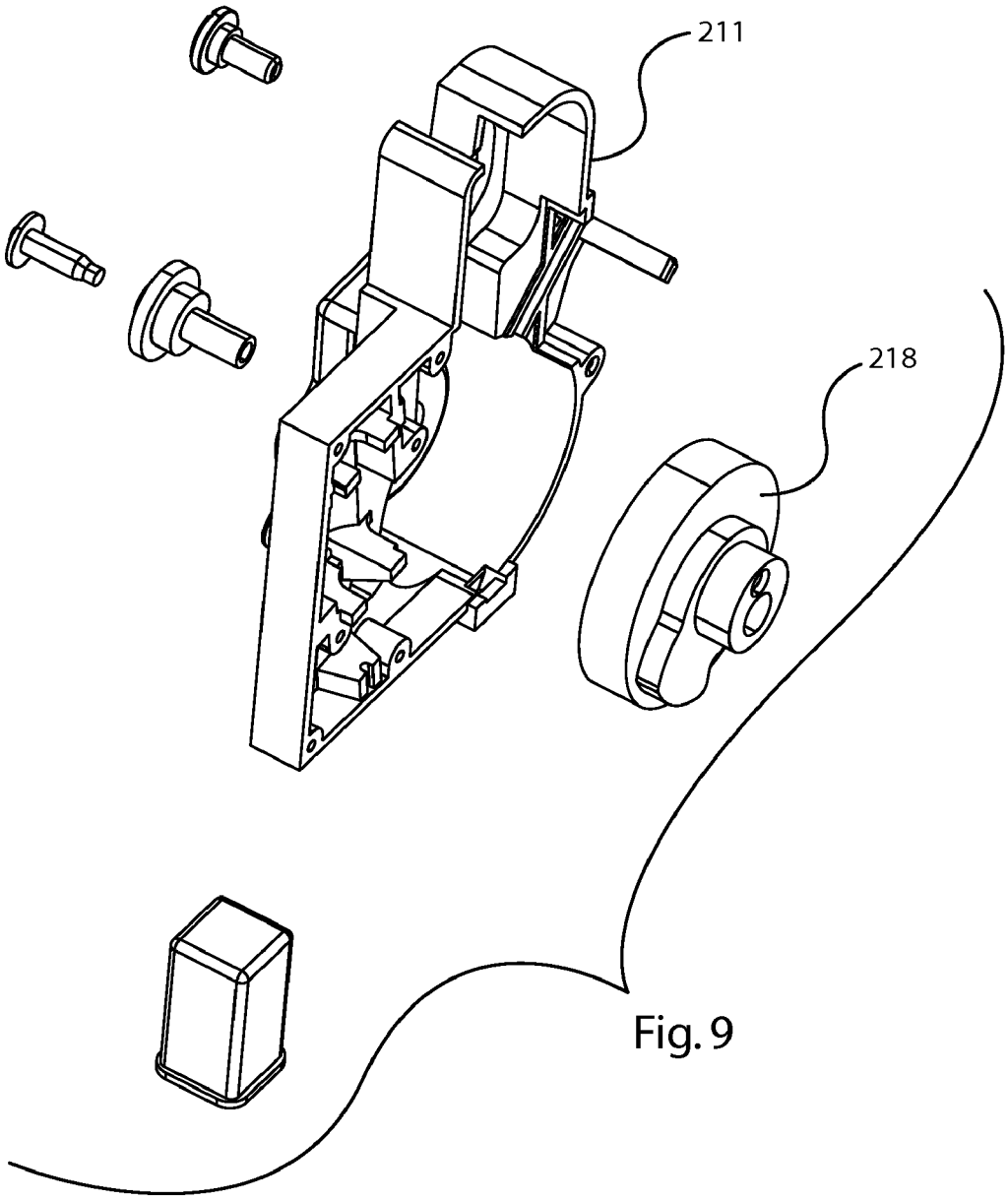
FIGS. 9 and 10 are enlarged portions of the exploded view of FIG. 8.
Figure 10:
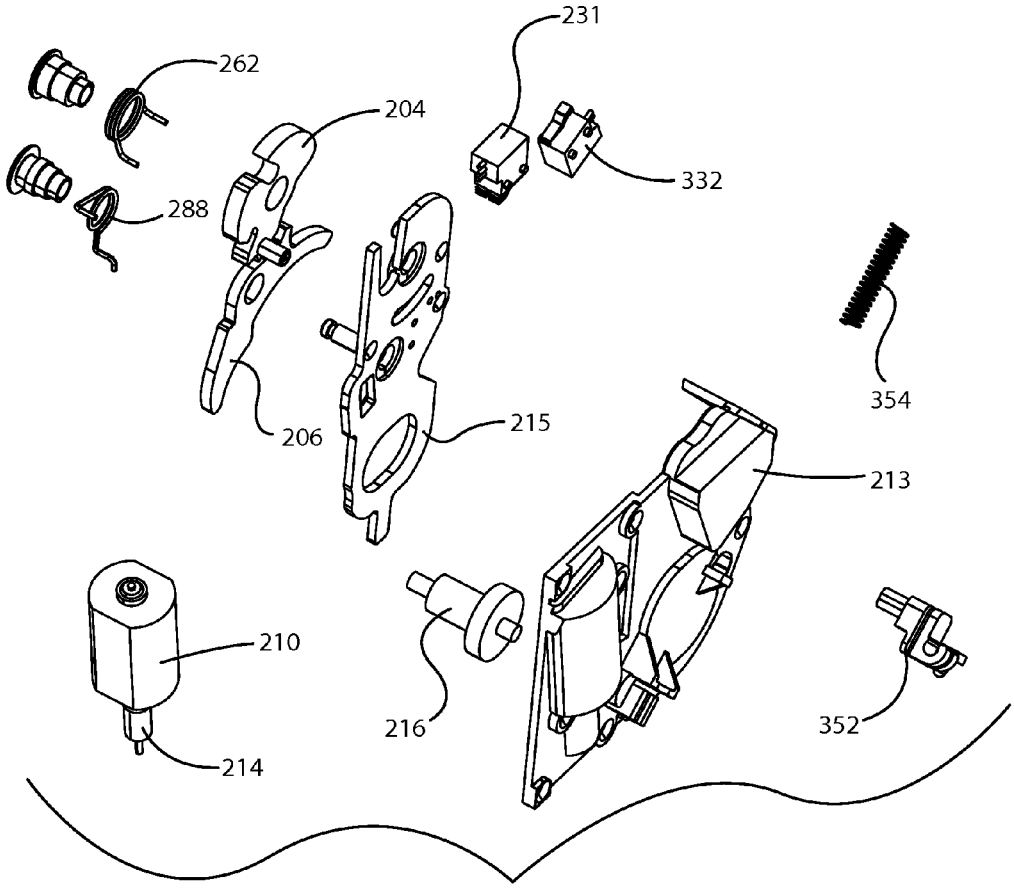
Figure 11:
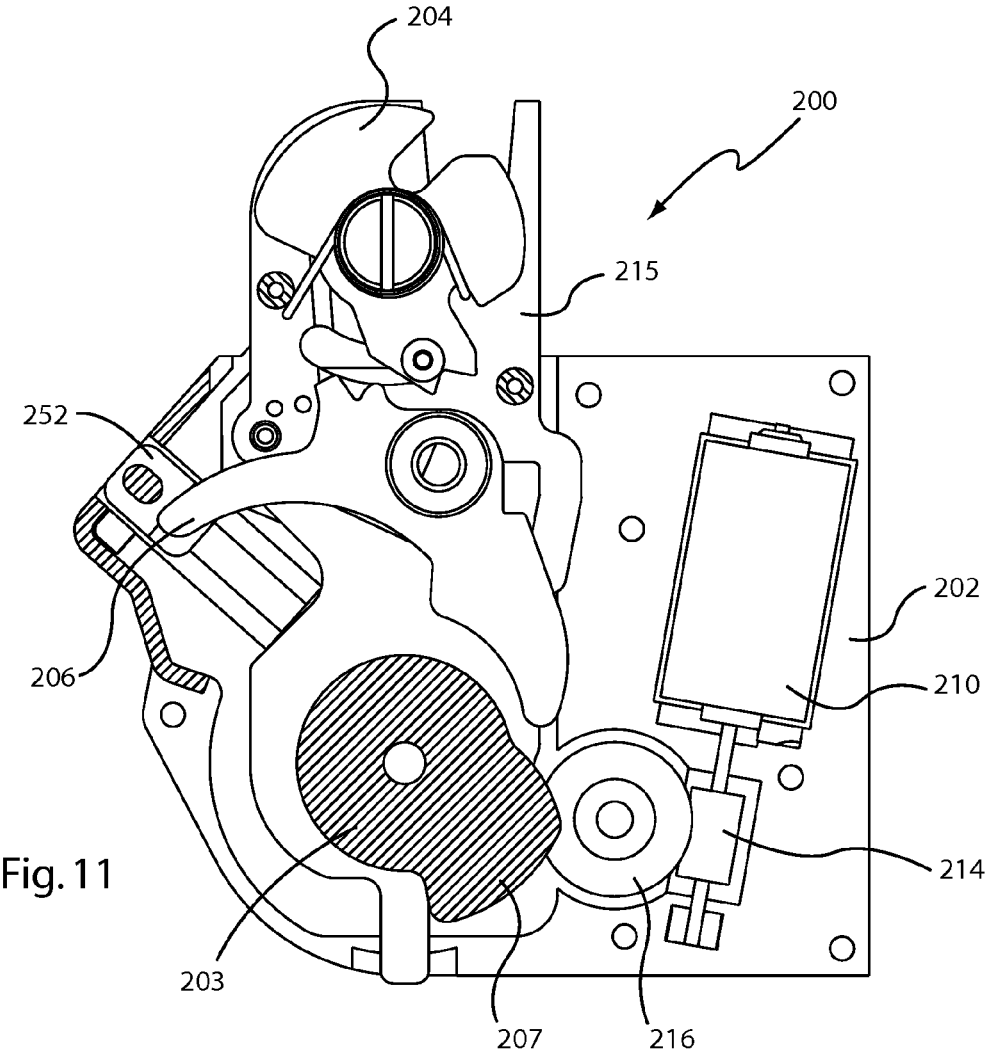
FIG. 11 is a side view of the latch of the present invention showing the latch in the fully unlatched configuration with the first portion of the housing removed.
Figure 117:
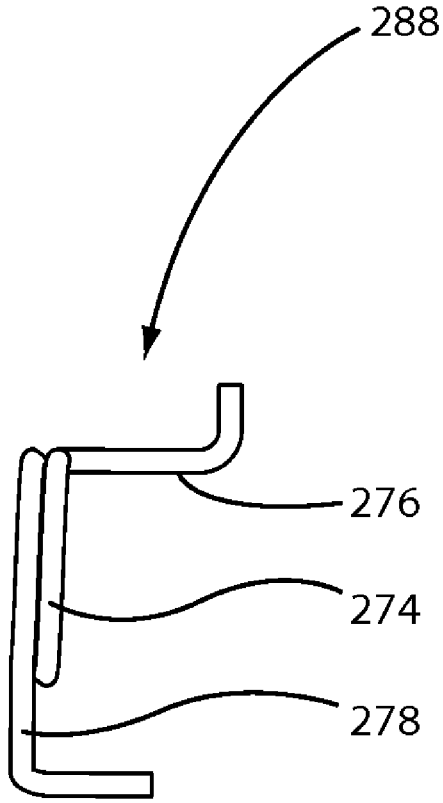

Referring to FIGS. 1-117, a latch 200 in accordance with an exemplary embodiment of the present invention can be seen. The latch 200 includes a latch housing 202, a pawl 204, a trigger or catch 206, and actuation means for selectively moving the trigger 206 out of engagement with the pawl 204 and retracting the pawl toward the interior of the housing 202. In the illustrated embodiment, an electrically operated actuator assembly 208 serves as the actuation means for selectively moving the trigger 206 out of engagement with the pawl 204 and retracting the pawl toward the interior of the housing 202.

The latch 200 is generally applicable wherever one or more closure members need to be secured in a certain position. The latch 200 can be used together with the striker 308 to secure any two closure members together. In the illustrated example, the latch 200 is shown being used for securing a trunk lid 300 relative to the trunk of a vehicle (not shown). In use, the latch 200 can be secured to the interior of the vehicle trunk, such that it can be engaged by the striker 308, using any well known means such as, for example, screws or the like.

Preferably, the housing 202 is of the clam-shell type having a first portion 211 and a second portion 213 so as to allow the housing 202 to receive the various components of the latch 200. Furthermore, the housing must be adapted to allow an unobstructed path to the pawl slot 258 for the striker 308 when the pawl 204 is in the open configuration relative to the support plate 215. The housing 202 has an opening that allows at least a portion of the striker 308 to enter the housing 202 for engagement by the pawl 204. In the illustrated example, the opening is in the form of a slot 212 that passes through the first portion 211 of the housing 202. The slot 212 forms an open, approximately U-shaped cut-out in the housing 202 as viewed in profile. The slot 212 allows at least a portion of the striker 308 to enter the housing 202 for engagement by the pawl 204. The slot 212 allows an unobstructed path to the pawl slot 258 when the pawl 204 is in the open configuration relative to the support plate 215. The slot 212 is sized such that the housing 202 will not interfere with the movement of the striker 308 relative to the housing 202 as the pawl 204 is moved from the open configuration to the closed configuration relative to the support plate 215 by contact with the striker 308 and as the pawl 204 is retracted toward the interior of the housing 202 by the electrically operated actuator assembly 208.

The electrically operated actuator assembly 208 includes a motor 210, a worm gear 214 that is in the form of an Archimedes or helical screw, a pinion gear 216, a cam gear 218 and the support plate 215. The motor 210 has an output shaft 220 that normally rotates in response to the motor being energized. Reversing the polarity of the current supplied to the motor 210 causes the direction of rotation of the output shaft 220 to be reversed. The motor 210 is received in the housing 202 and is installed at a fixed location therein. The worm gear 214 is diagrammatically represented in the attached drawings. The worm gear 214 is attached to the output shaft 220 of the motor 210 such that the worm gear 214 rotates with the shaft 220 as a unit during normal operation of the latch 200.

The pinion gear 216 includes two adjacent coaxial gear wheels 229, 227 that rotate as a unit about a common axis of rotation. The first gear wheel 229 is of a larger diameter as compared to the second gear wheel 227. In the illustrated example, the pinion gear 216, including the gear wheels 229, 227, is of one-piece construction. The pinion gear 216 also includes two axially projecting pivot pins 223, 225 for rotationally supporting the pinion gear 216 in the housing 202. The worm gear 214 is in mesh with the pinion gear 216. In the illustrated example, the helical screw of the worm gear 214 engages the gear teeth (not shown) of the gear wheel 229, such that the worm gear 214 is in mesh with a first portion of the pinion gear 216. Accordingly, rotation of the worm gear 214 causes rotation of the pinion gear 216 when the motor 210 is energized.

The cam gear 218 includes a gear wheel 222, a proximal cam 203, and a distal cam 205. The proximal cam 203 is adjacent the gear wheel 222. The distal cam 205 is adjacent the proximal cam 203, with the proximal cam 203 being intermediate the gear wheel 222 and the distal cam 205. The gear wheel 222, the proximal cam 203, and the distal cam 205 rotate as a unit about a common axis of rotation. The gear wheel 222 of the cam gear 218 has a plurality of gear teeth (not shown) evenly distributed about its circumference. The proximal cam 203 has an arc-shaped cam lobe 207, located at a distance from the axis of rotation of the cam gear 218, for tripping the catch or trigger 206. The distal cam 205 is substantially in the shape of a right circular cylinder supported eccentrically relative to the axis of rotation of the cam gear 218. In the illustrated example, the cam gear 218, including the gear wheel 222, the proximal cam 203, and the distal cam 205, is of one-piece construction. The cam gear 218 is rotationally supported in the housing 202 by the cam gear pin 209. The cam gear pin 209 is held in place by the cam gear screw 217. The cam gear 218 is in mesh with the pinion gear 216. In the illustrated example, the teeth (not shown) of gear wheel 222 of the cam gear 218 engage the gear teeth (not shown) of the gear wheel 227, such that the cam gear 218 is in mesh with a second portion of the pinion gear 216. Accordingly, rotation of the pinion gear 216 causes rotation of the cam gear 218 when the motor 210 is energized.

The support plate 215 is supported for rectilinear translation by the housing 202. The support plate 215 rotationally supports the pawl 204. The support plate 215 pivotally supports the trigger 206. The support plate 215 has a cut-out 224 proximate the pawl 204 such that the support plate 215 will not interfere with the movement of the striker 308 relative to the support plate 215 as the pawl 204 is moved from the open configuration to the closed configuration relative to the support plate 215 by contact with the striker 308. The support plate 215 has an elongated slot 226 that is engaged by the distal cam 205 of the cam gear 218, such that rotation of the cam gear 218 causes reciprocating, rectilinear movement of the support plate 215 relative to the housing 202. The elongated slot 226 has a width that is approximately equal to the diameter of the distal cam 205, while the length of the elongated slot 226 is greater than the sum of the diameter of the distal cam 205 and twice the distance between the central axis of the distal cam 205 and the axis of rotation of the cam gear 218.

As previously stated the latch assembly 200 includes a pawl 204 shown pivotally or rotationally connected to the support plate 215 with suitable attachment means such as the pawl pivot pin 238 that passes through the hole 240 in the pawl 204. The support plate 215 is provided with a hole 232 for receiving one end of the pivot pin 238. Thus, the pawl 204 is rotationally supported by the support plate 215.

The pawl 204 has first and second teeth 254, 233 provided for engagement by the trigger 206. The pawl 204 is provided with a pawl slot 258 to capture and hold the striker 308 when the pawl 204 is in either one of a first latched position (shown in FIGS. 4 and 12-18) and a second latched position (shown in FIGS. 28 and 29) relative to the support plate 215. In the illustrated example, the striker 308 has a rod-shaped portion 234 that engages the pawl slot 258 as the trunk lid 300 is moved to the closed position relative to the vehicle's trunk (not shown) and consequently relative to the latch 200.

During normal operation, assuming the latch 200 is initially in the normal unlatched configuration shown in FIGS. 1, 2, 5, 6, 7, and 11, when the trunk lid 300 is closed, the rod-shaped portion 234 of the striker 308 will be positioned or caught in the pawl slot 258 with the pawl 204 being moved to the first latched position relative to the support plate 215.

A pawl torsion spring 262 is installed on the support plate 215 with the coiled portion 264 of the torsion spring 262 surrounding the pivot pin 238. An arm 268 of the torsion spring 262 engages the notch 260 in the pawl 204. The torsion spring 262 also has a second arm 272 that engages the support plate 215.

With the arm 272 of the torsion spring 262 in engagement with the support plate 215, the arm 268 of the torsion spring 262 exerts a force on the pawl 204 that biases the pawl 204 toward the open or unlatched position relative to the support plate 215.

The trigger 206 is pivotally supported on the support plate 215. The pivot axis of the trigger 206, as defined by the trigger pivot pin 270, is parallel to the pivot axis or axis of rotation of the pawl 204. Furthermore, the pivot axis of the trigger 206, as defined by the trigger pivot pin 270, is spaced apart from the pivot axis or axis of rotation of the pawl 204. The trigger 206 is pivotally movable between any one of a first engaged position (shown in FIGS. 12-18) and a second engaged position (shown in FIGS. 28 and 29) and a disengaged position (shown in FIGS. 19, 20, 30, and 31) and is spring biased toward the first and second engaged positions. In the illustrated embodiment, the first and second engaged positions of the trigger 206 may be coincident, but they need not be so. A trigger spring 288 is provided for biasing the trigger 206 toward the first and second engaged positions. The trigger spring 288 is a torsion spring and has a coiled portion 274, a first arm 276, and a second arm 278. The trigger spring 288 is installed on the support plate 215 with the coiled portion 274 of the torsion spring 288 surrounding the trigger pivot pin 270. The arm 276 of the torsion spring 288 engages the step or notch 282 in the trigger 206. The second arm 278 of the torsion spring 288 engages the support plate 215.

The trigger 206 has a first lever arm 284 and a second lever arm 286 that extend approximately along the same arc on either side of the pivot axis of the trigger 206 as defined by the trigger pivot pin 270. The trigger pivot pin 470 passes through a hole in the trigger 206. The trigger 206 has a notch 290 that receives and engages the first tooth 254 of the pawl 204 to hold or retain the pawl 204 in the first latched position relative to the support plate 215. Also, the notch 290 of the trigger 206 receives and engages the second tooth 233 of the pawl 204 to hold or retain the pawl 204 in the second latched position relative to the support plate 215.

Figure 12:
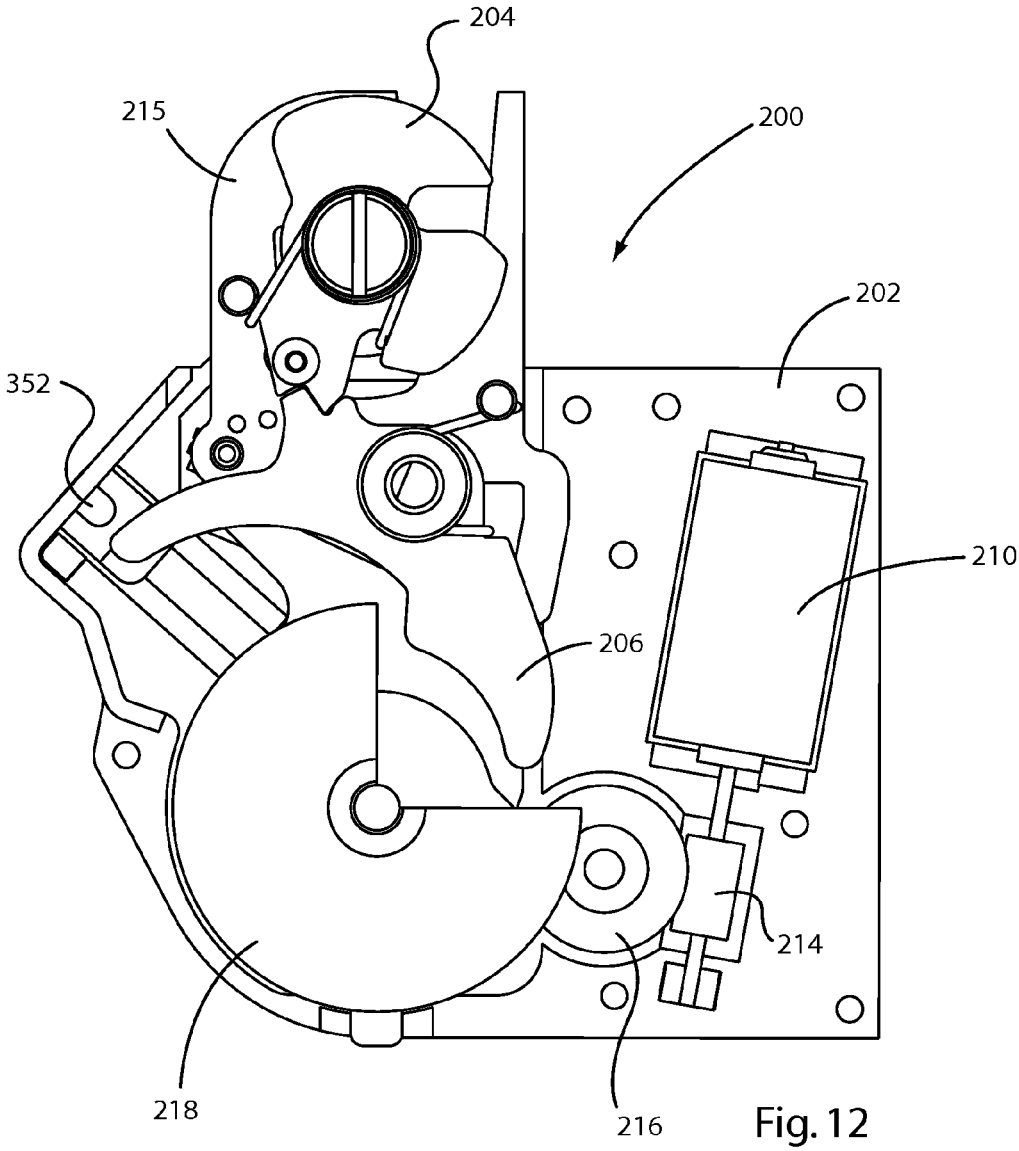
FIG. 12 is a side view of the latch of the present invention showing the latch pawl in the first latched configuration and the support plate not retracted with the first portion of the housing removed.
Figure 13:
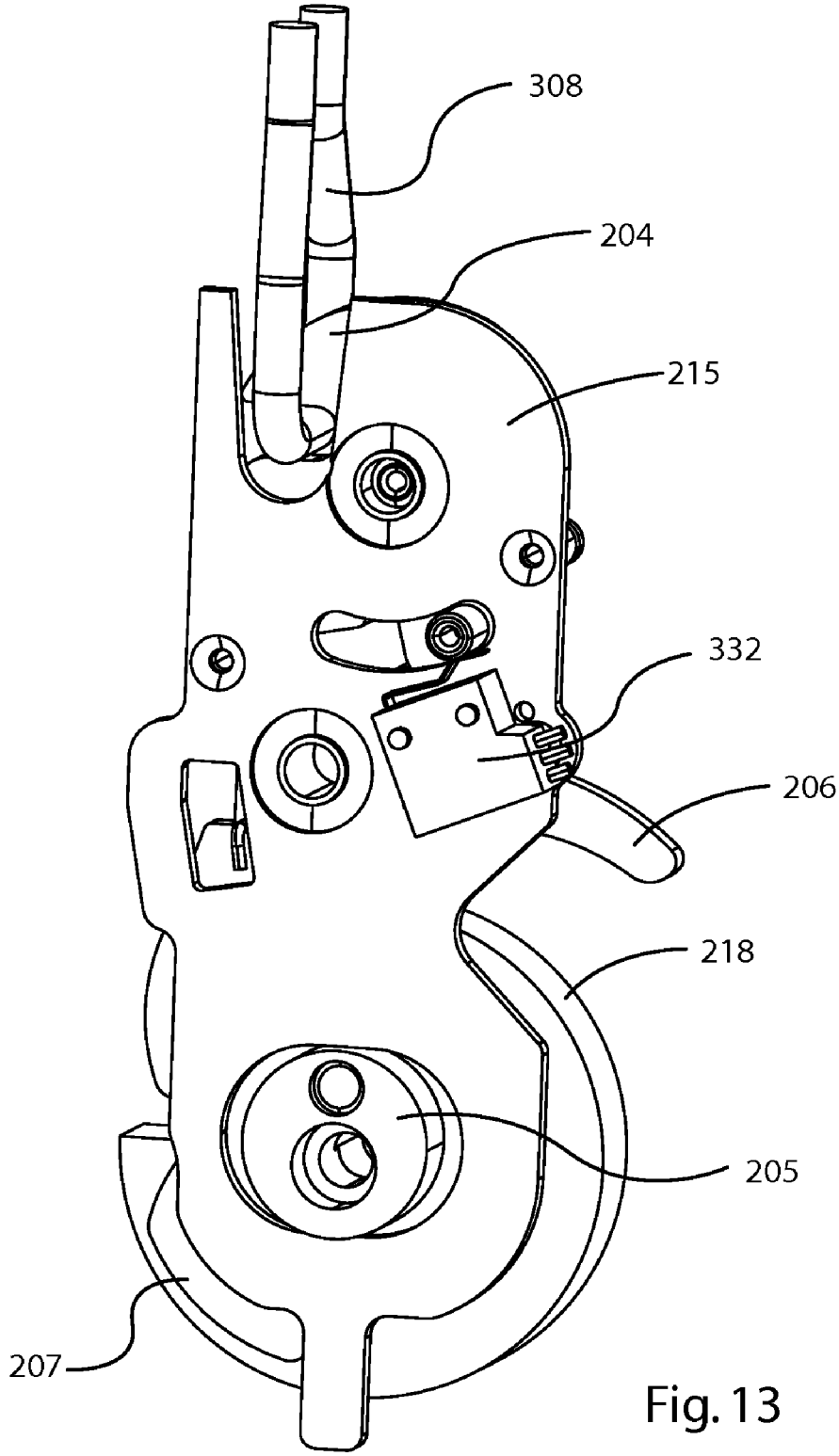
FIG. 13 is a view of the latch of the present invention showing the latch pawl in the first latched configuration and the support plate not retracted with the housing completely removed.
Figure 14:
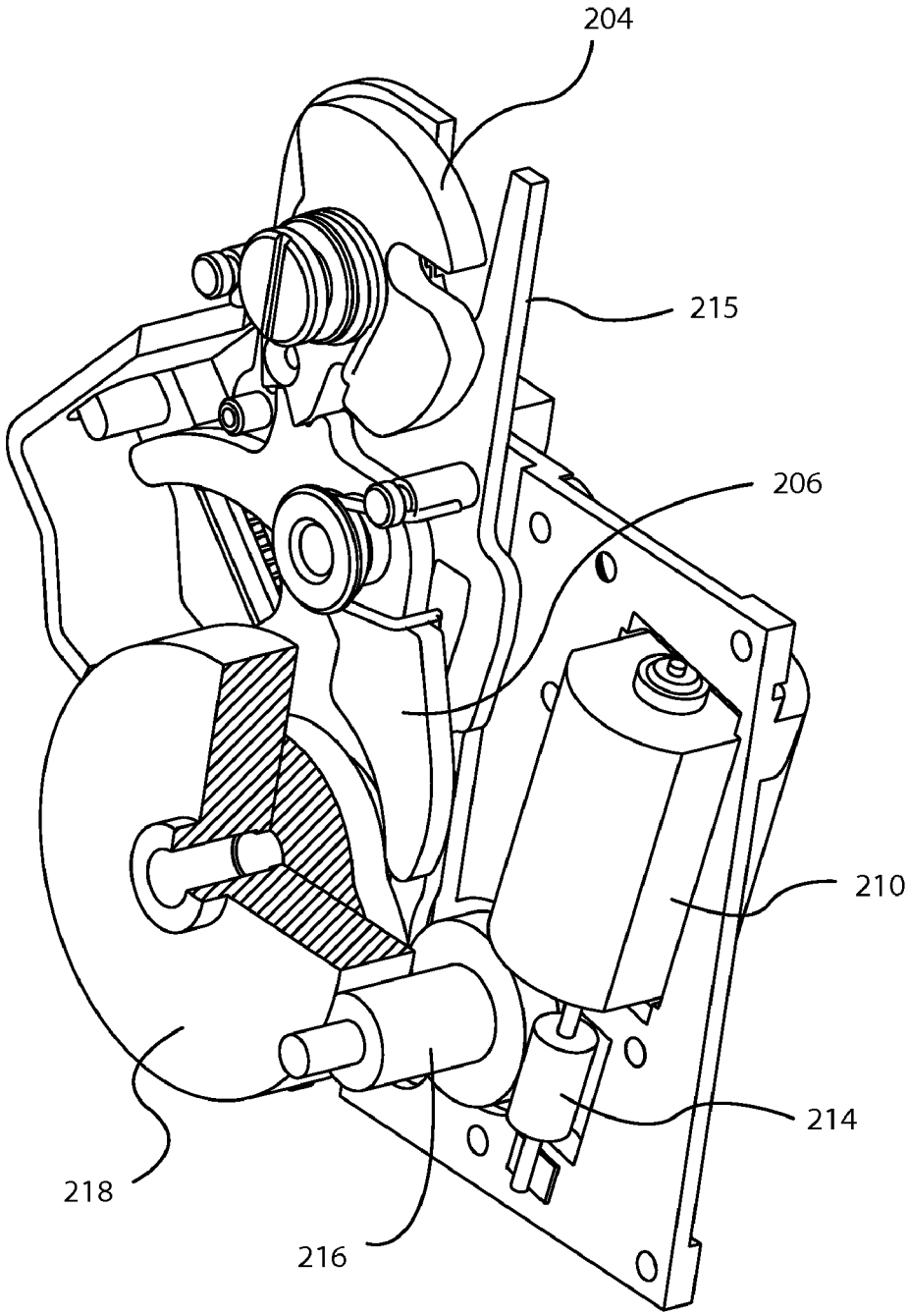
FIG. 14 is an isometric view of the latch of the present invention showing the latch pawl in the first latched configuration and the support plate not retracted with the first portion of the housing removed.
Figure 15:
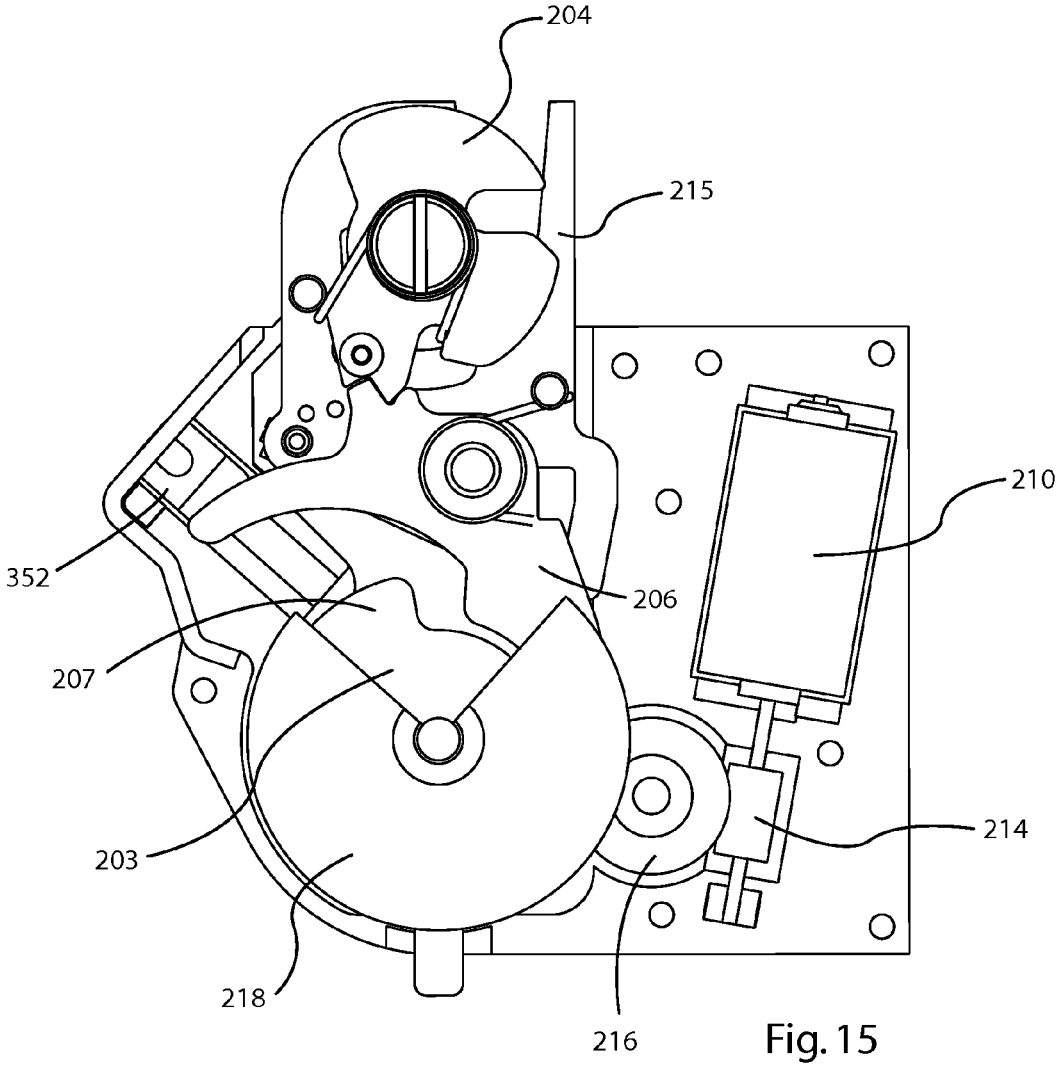
FIG. 15 is a side view of the latch of the present invention showing the latch pawl in the first latched configuration and the support plate retracted with the first portion of the housing removed.
Figure 16:
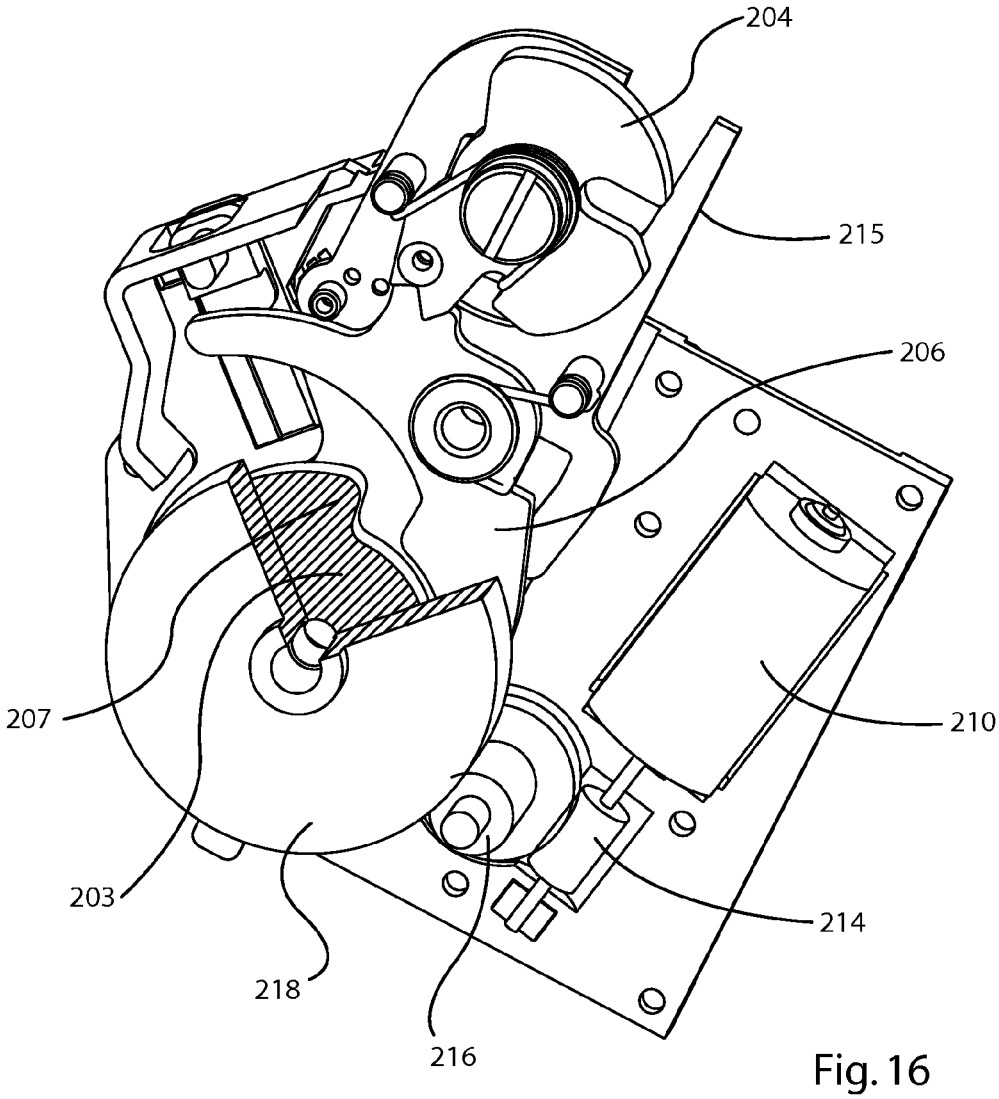
FIG. 16 is an isometric view of the latch of the present invention showing the latch pawl in the first latched configuration and the support plate retracted with the first portion of the housing removed.

The operation of the latch 200 will now be explained. With the latch initially in the fully unlatched configuration of FIGS. 1, 2, 5-7, and 11, as the trunk lid 300 is moved to the closed position, the rod-shaped portion 234 of the striker 308 will be positioned or caught in the pawl slot 258 with the pawl 204 being moved to the first latched position relative to the support plate 215 as a result of the contact of the striker 308 with the pawl 204. The pawl 204 is now in the first latched position relative to the support plate 215 as illustrated in FIGS. 12-14. The trigger 206 is in its first engaged position relative to the support plate 215 and retains the pawl 204 in its first latched position. The cam lobe 207 of the cam gear 218 is in its initial position shown in FIGS. 12 and 14 where it does not contact the trigger 206. As shown in FIG. 13, when the pawl 204 reaches the first latched position a pin 219 carried by the pawl and projecting through the arc-shaped slot 221 in the support plate 215 trips a microswitch 332 that is mounted on the side of the support plate 215 opposite the pawl 204. Once the microswitch 332 is tripped a signal is generated to an electronic control circuit (not shown) that controls the current supplied to the motor 210, and in response the control circuit causes the supply of electrical current to the motor 210 with a first polarity to cause the rotation of the cam gear 218 to the position illustrated in FIGS. 15 and 16. This is the fully latched configuration of the latch 200 and the cam lobe 207 of the cam gear 218 is in its fully latched position relative to the housing 202. As the cam gear 218 rotates from its initial position to its fully latched position, the cam lobe 207 does not contact the trigger 206. As the cam gear 218 rotates from its initial position to its fully latched position, the distal cam 205 causes the support plate to move rectilinearly to the retracted position shown in FIGS. 15 and 16, corresponding to the fully latched configuration of the latch 200. During the rectilinear movement of the support plate 215 to the retracted position, the support plate 215 rectilinearly translates about 5.5 mm inward relative to the housing 202. This movement of the support plate 215 pulls the striker 308 about 4.5 mm toward the interior of the latch 200. In use, this would compress a sealing gasket (not shown) provided around the edge of the trunk lid 300 with a compressive force of up to 800 N.

In the fully latched position a second microswitch 231 of the double switch type, supported by the housing 202, senses that the latch is in the fully latched position and signals the control circuit to shut off the supply of electrical current to the motor 210. The latch is now fully latched. The microswitch 231 can sense when the cam gear 218 is in the position corresponding to the fully latched position of the latch and when the cam gear 218 is in the position corresponding to the unlatched position of the latch. This can, for example, be accomplished by two projections (not shown) that are 180° apart and are provided on the side of the gear wheel 222 opposite the cam lobe 207. These projections would trip the microswitch 231 in either position of the cam gear 218. Alternatively, two microswitches can be provided in the housing 202 that are 180° apart and that are tripped by a single projection on the gear wheel 222. These are examples of the many configurations for detecting the position of a gear wheel that are well known in the art and can be used in the present invention. The present design can withstand a force of up to 12,000 N without breaking.

If normal closing is blocked, for example by items in the trunk, after a predetermined time without a signal from the microswitch 231, the control circuit reverses the current to the motor to trip the trigger 206 by the reverse movement of the cam lobe 207 and the trunk lid 300 is released and the latch 200 is returned to the initial fully unlatched configuration.

Figure 17:
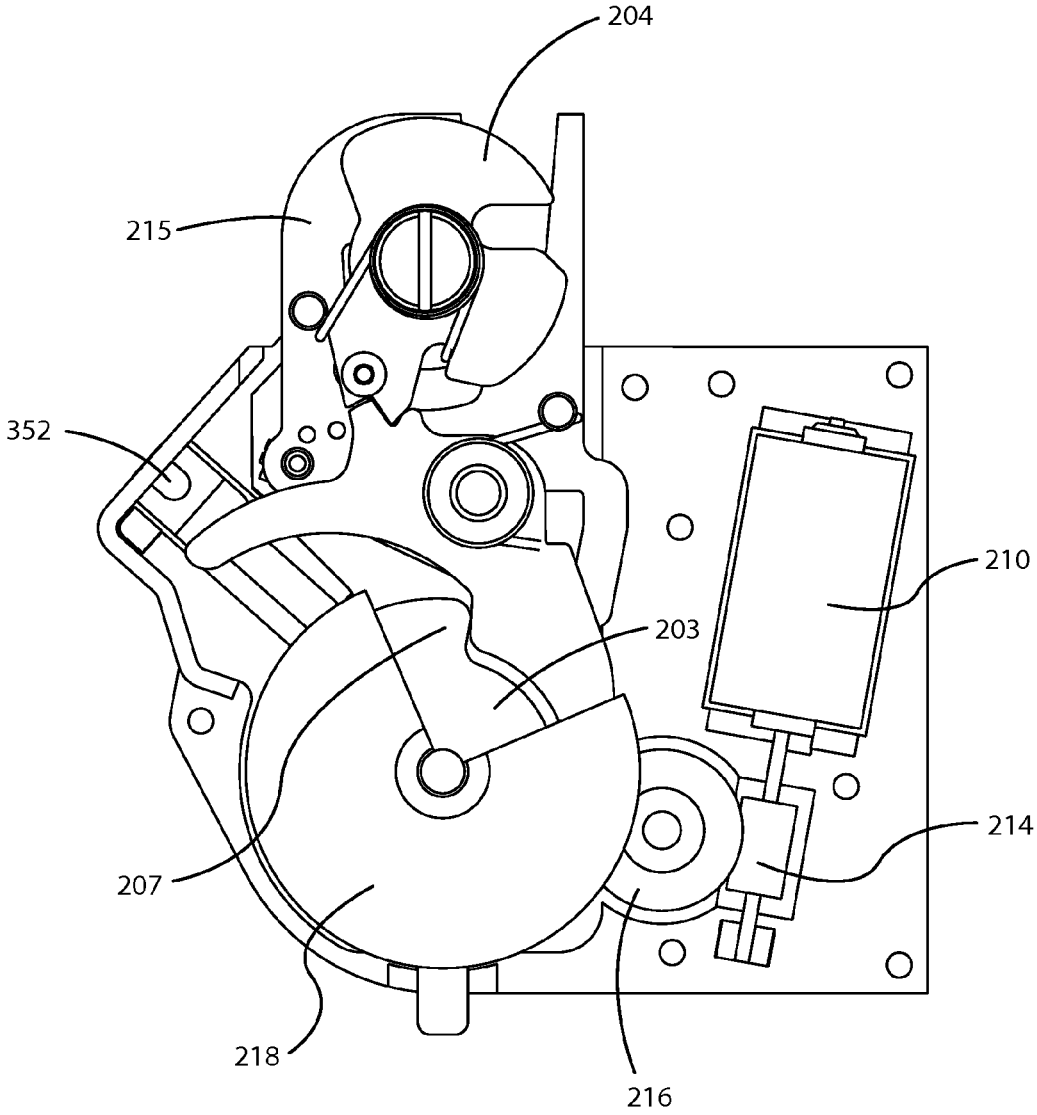
FIG. 17 is a side view of the latch of the present invention showing the latch pawl in the first latched configuration just after initiation of the unlatching sequence with the first portion of the housing removed.
Figure 18:
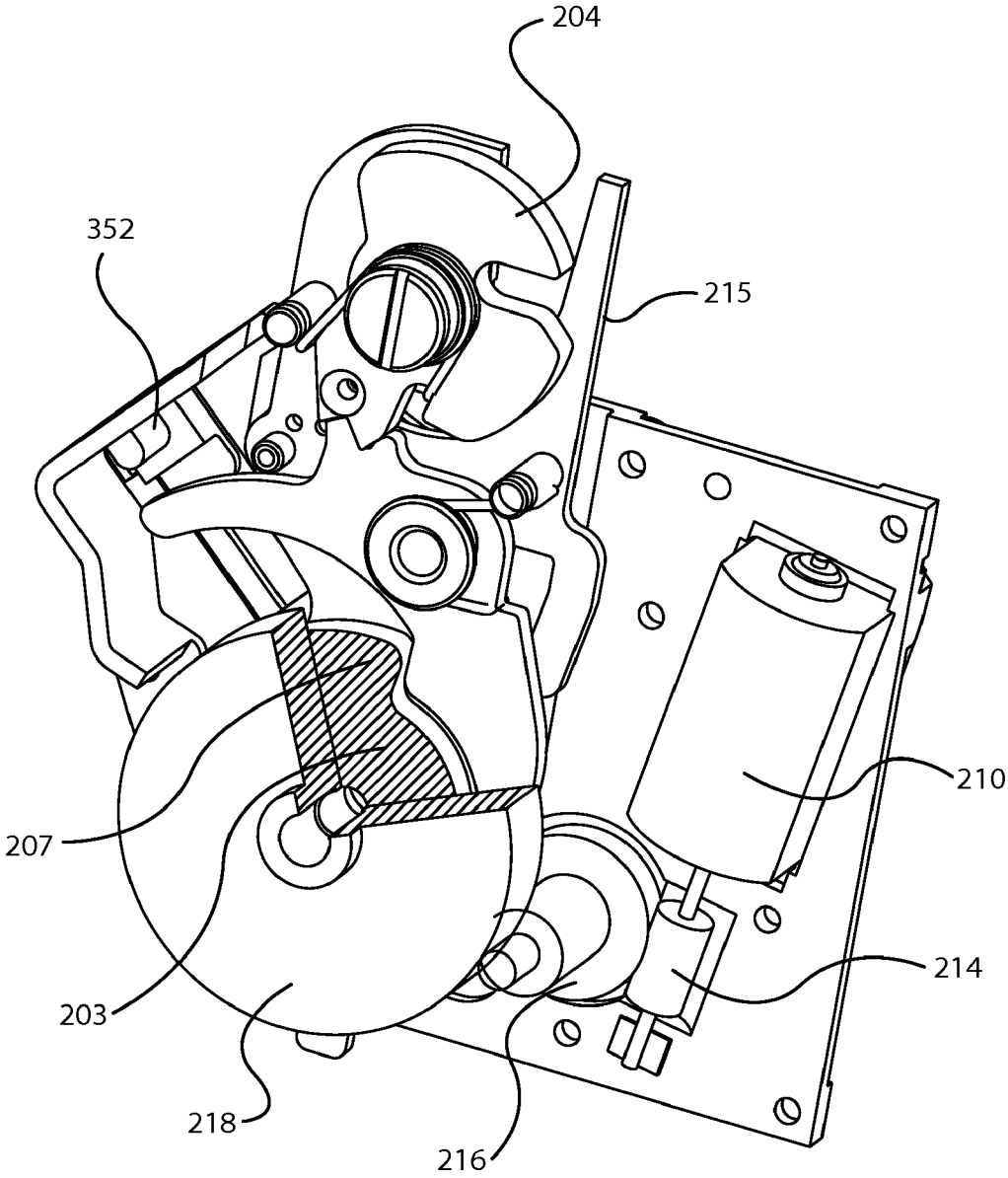
FIG. 18 is an isometric view of the latch of the present invention showing the latch pawl in the first latched configuration just after initiation of the unlatching sequence with the first portion of the housing removed.
Figure 19:
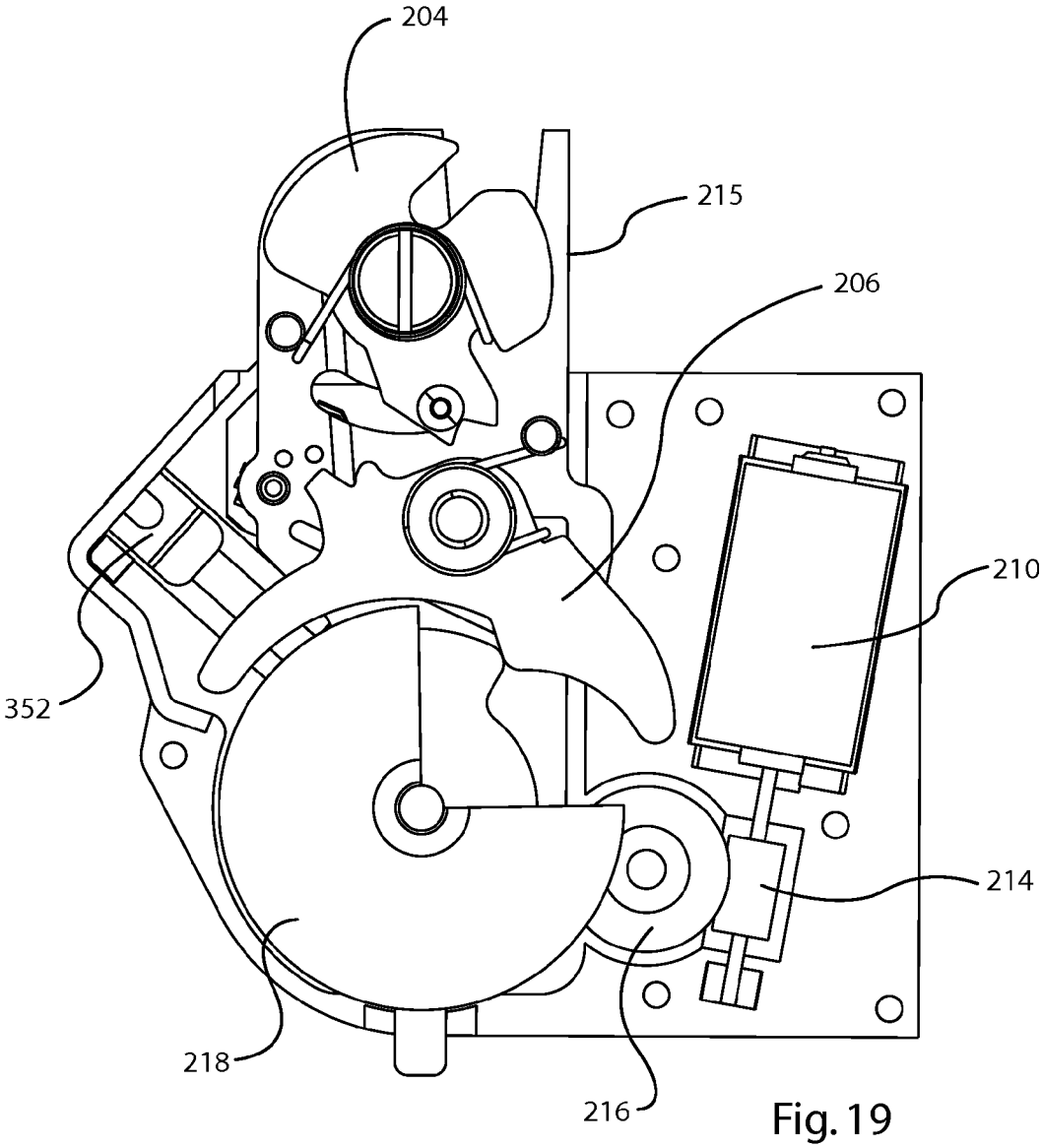
FIG. 19 is a side view of the latch of the present invention showing the latch pawl in the open configuration relative to the support plate with the support plate beginning to return to the extended position with the first portion of the housing removed.
Figure 20:
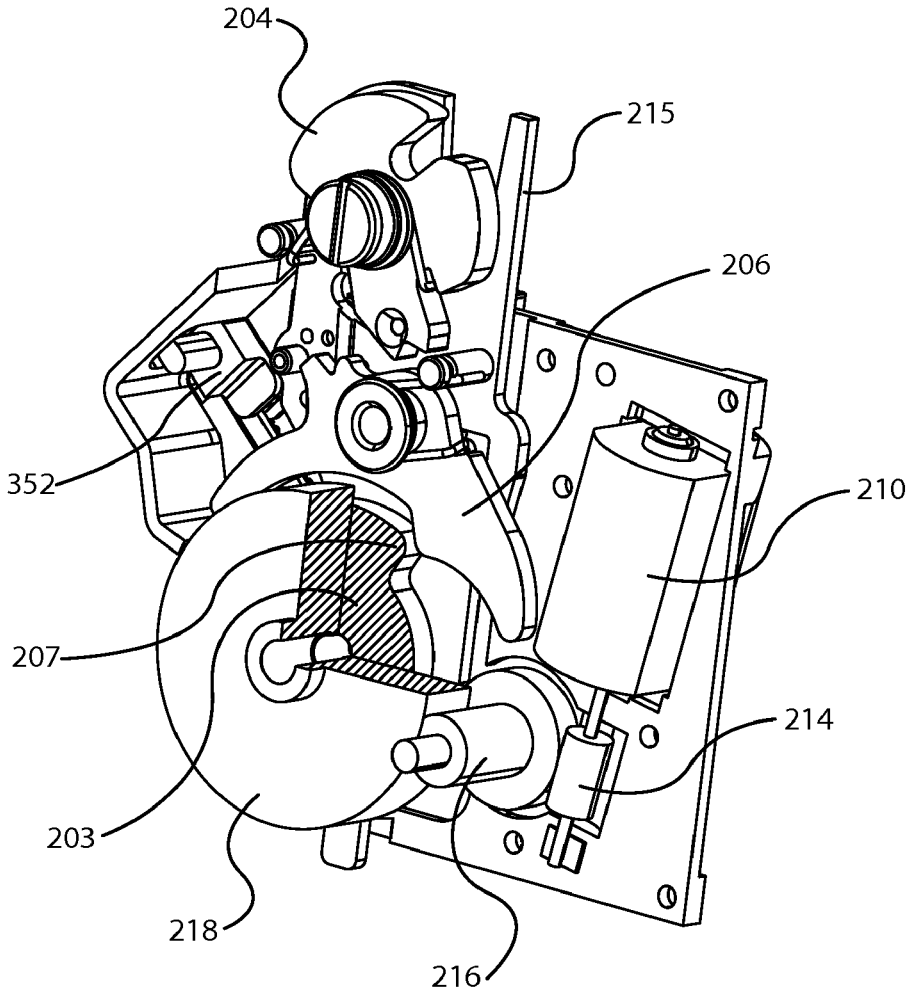
FIG. 20 is an isometric view of the latch of the present invention showing the latch pawl in the open configuration relative to the support plate with the support plate beginning to return to the extended position with the first portion of the housing removed.
Figure 21:
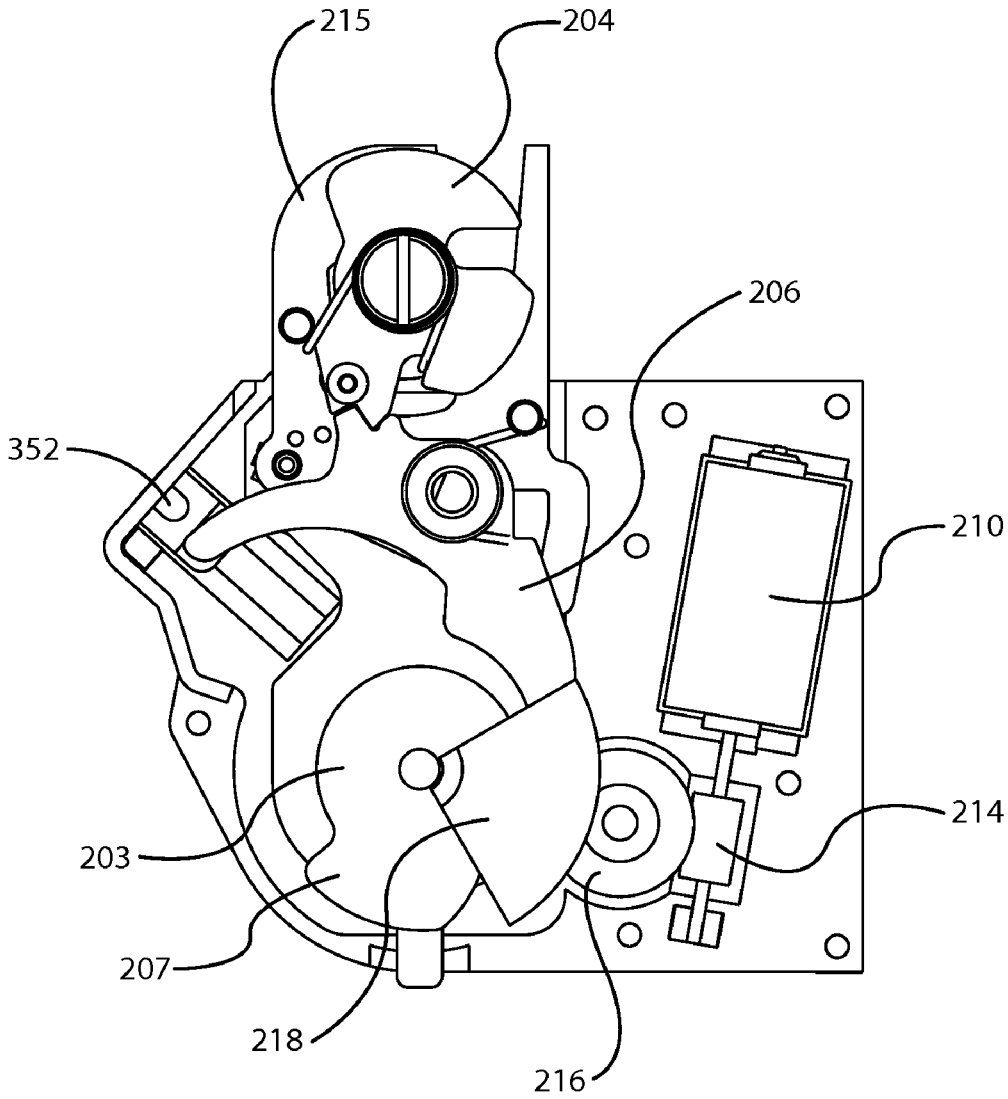
FIG. 21 is a side view of the latch of the present invention showing the latch pawl in the first latched configuration relative to the support plate with the support plate beginning to move to the retracted position with the first portion of the housing removed.
Figure 22:
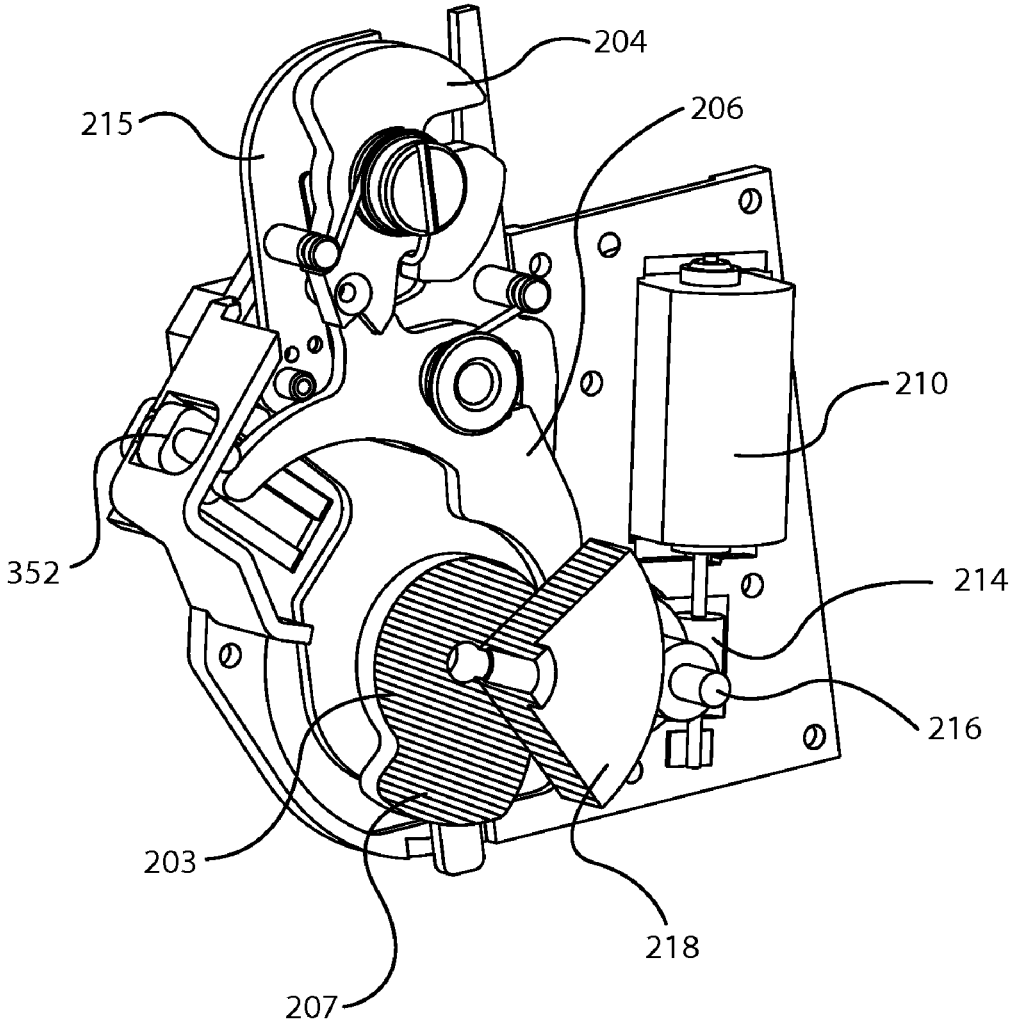
FIG. 22 is an isometric view of the latch of the present invention showing the latch pawl in the first latched configuration relative to the support plate prior to complete retraction of the support plate with the first portion of the housing removed.
Figure 23:
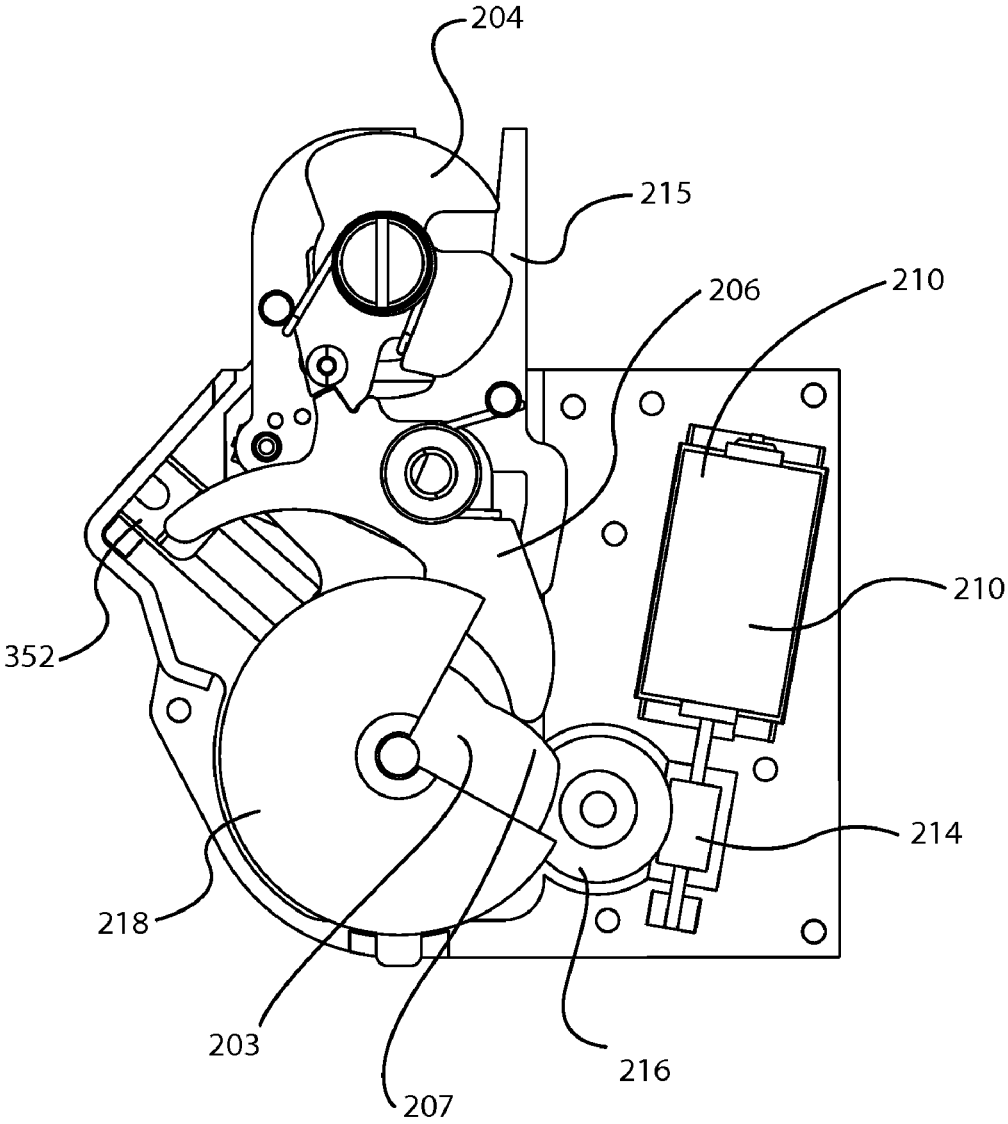
FIG. 23 is a side view of the latch of the present invention showing the latch pawl in the first latched configuration relative to the support plate prior to complete retraction of the support plate with the first portion of the housing removed.
Figure 24:
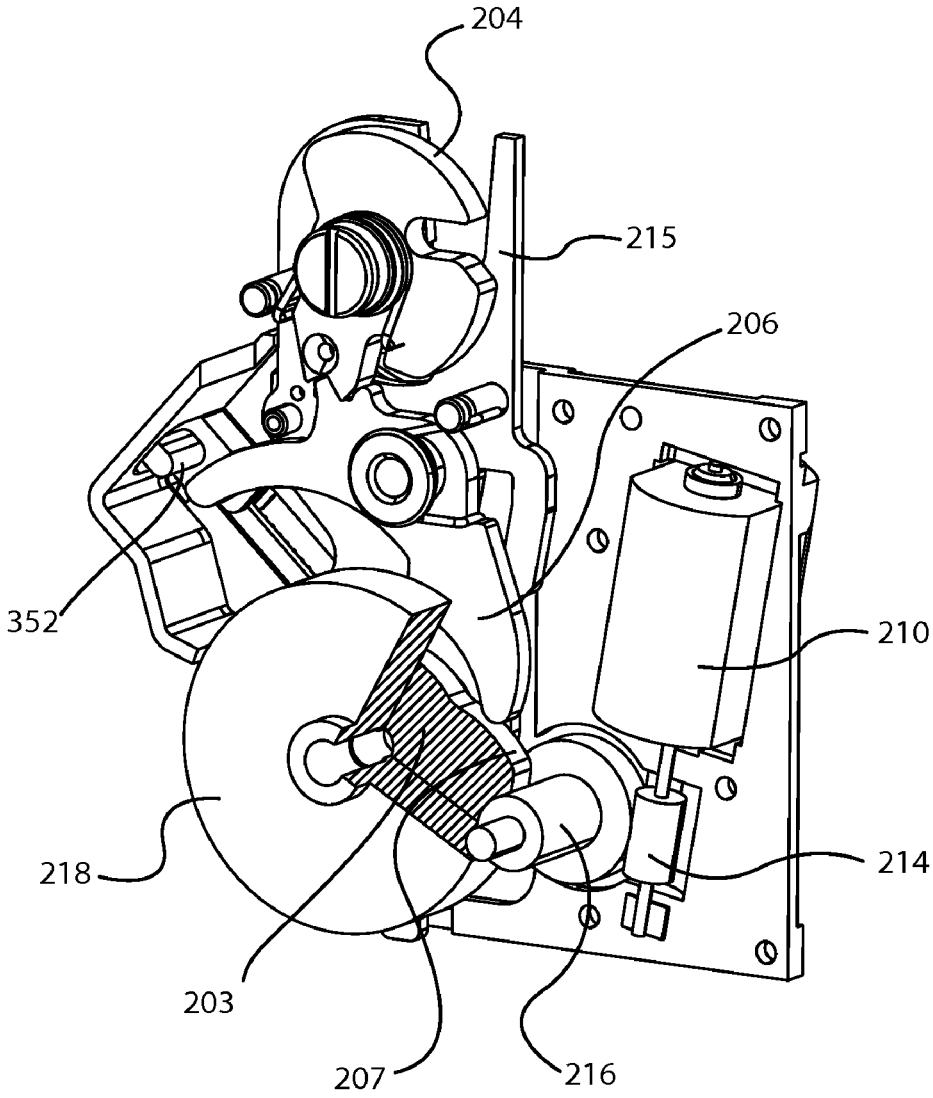
FIG. 24 is another isometric view of the latch of the present invention showing the latch pawl in the first latched configuration relative to the support plate prior to complete retraction of the support plate with the first portion of the housing removed.
Figure 25:
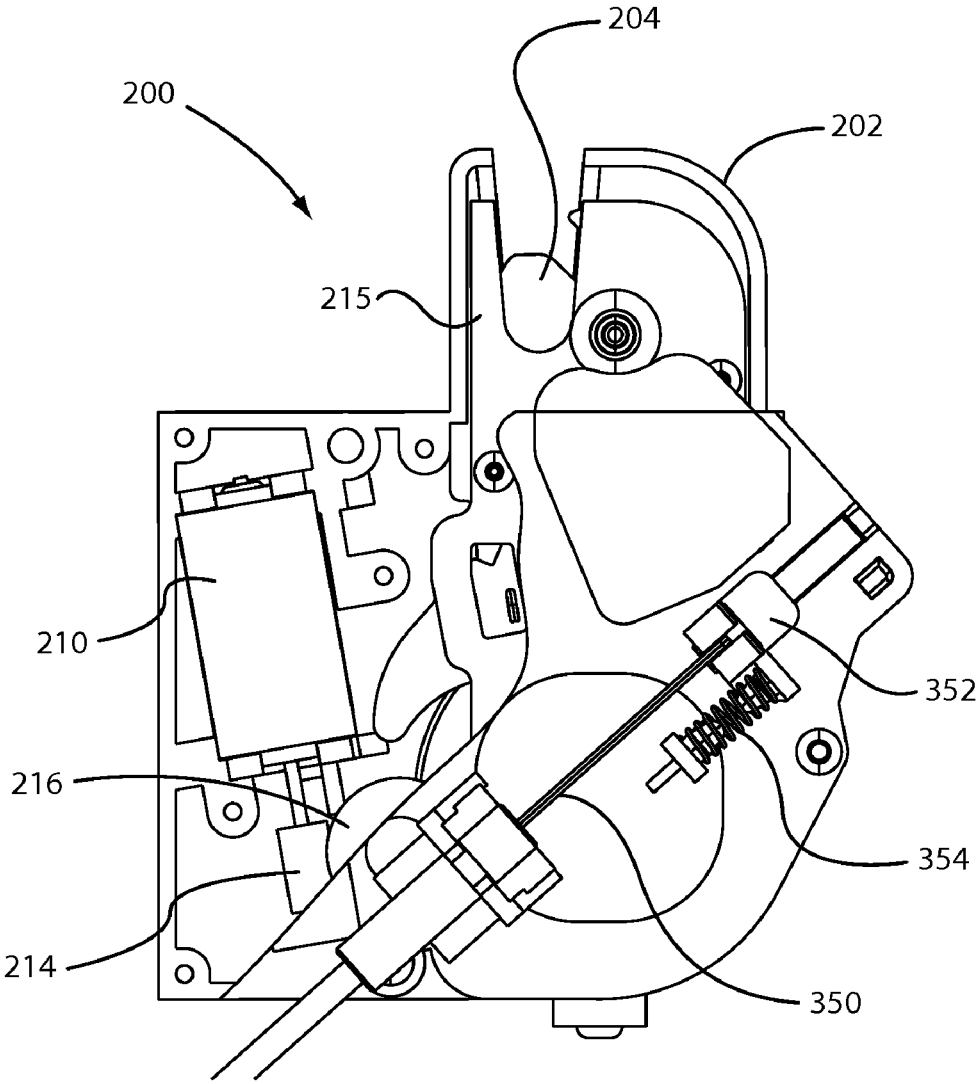
FIGS. 25-27 are views of the latch of the present invention showing the latch pawl in the open configuration relative to the support plate and the latch trigger actuated by the Bowden cable with portions of the housing removed.
Figure 26:
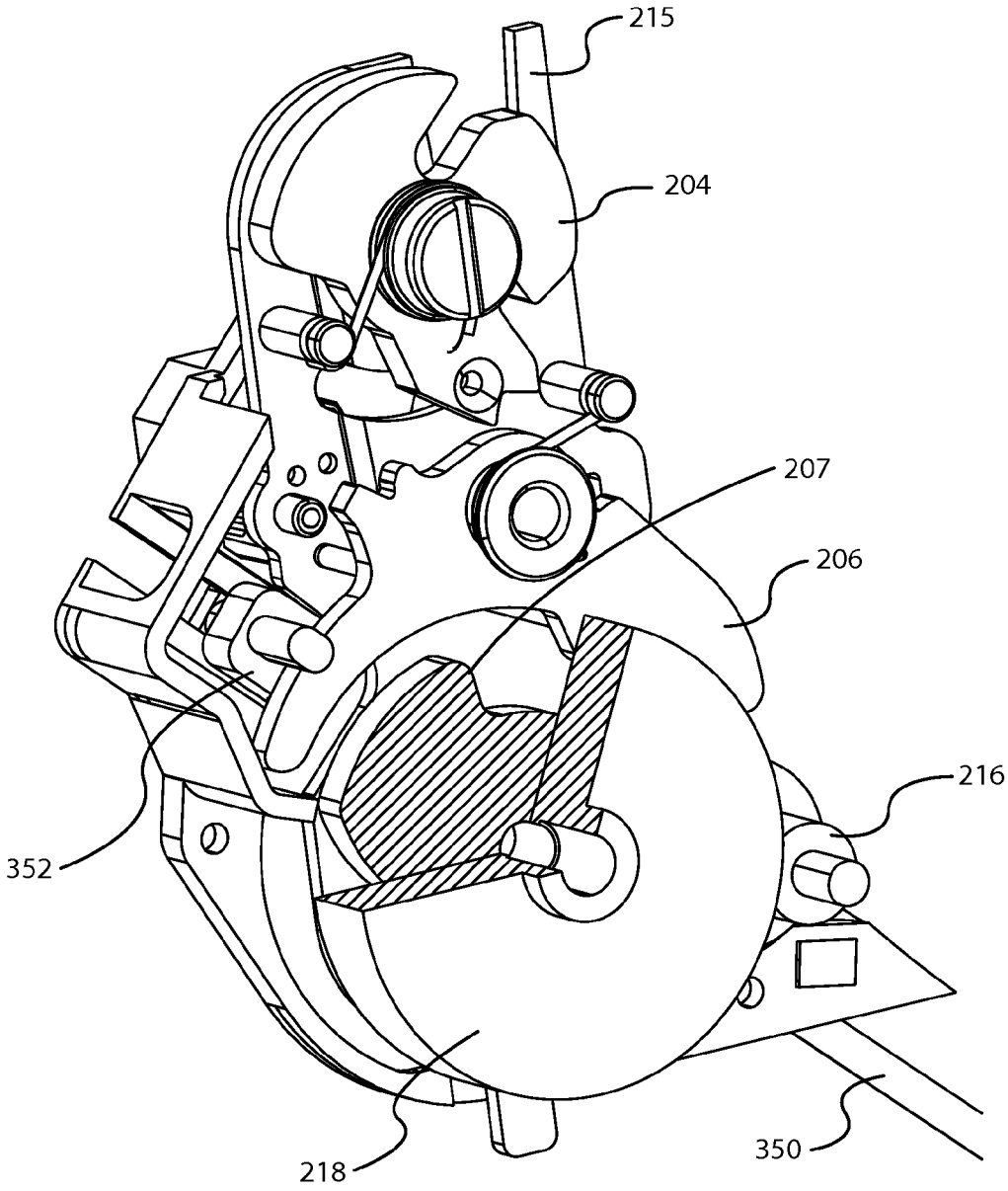
Figure 27:
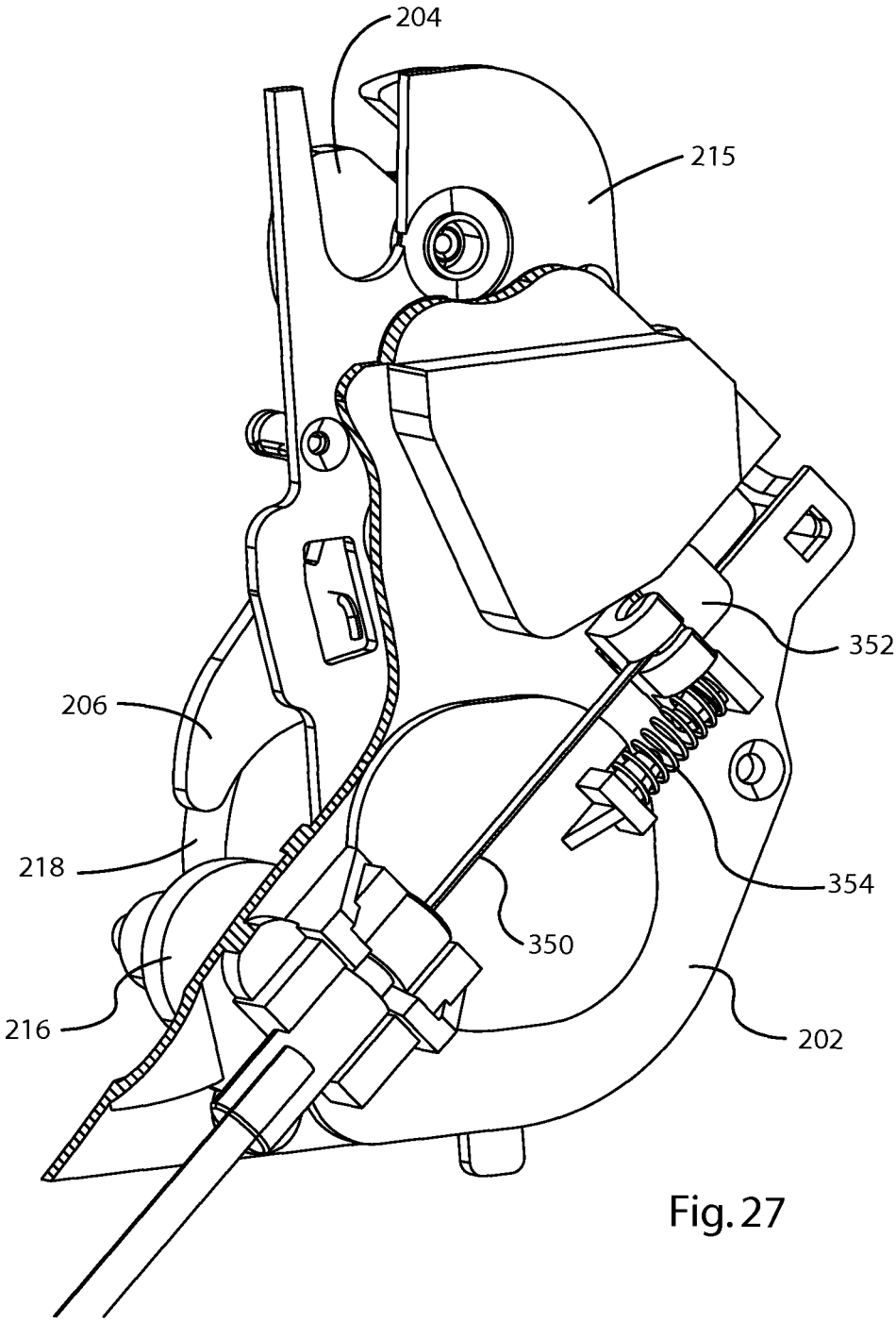

To open the latch 200 the motor 210 is energized by the user using a remotely located switch (not shown). The cam gear 218 rotates from the fully latched position of FIGS. 15 and 16 to bring the cam lobe 207 into contact with the first lever arm 284 of the trigger 206 as shown in FIGS. 17 and 18. The rotation of the cam gear 218 to its trigger release position trips the trigger 206 to release the pawl 204 as shown in FIGS. 19 and 20. The striker 308 is now released and the trunk lid 300 can be opened. The motor 210 remains energized until the cam gear 218 is once again in its fully unlatched position and the support plate 215 is return to its extended position as illustrated in FIGS. 1, 2, 5-7, and 11. The microswitch 231 senses that the latch 200 is in the fully unlatched position and signals the control circuit to stop energizing the motor.

Referring to FIGS. 22-27, if the motor 210 or associated circuitry fail with the latch fully latched and the trunk lid 300 closed, the Bowden cable 350 provides a back-up mechanical release mechanism that will be operated by a lever (not shown) from the interior of the vehicle. The Bowden cable 350 is engaged to a sliding block 352 that is supported for rectilinear movement by the housing 202. When the Bowden cable is pulled the sliding block 352 engages the second lever arm 286 to trip the trigger 206 and release the pawl 204 and consequently the striker 308, and the trunk lid can then be opened. A spring 354 returns the sliding block to its original position once the Bowden cable 350 is released.

Figure 28:
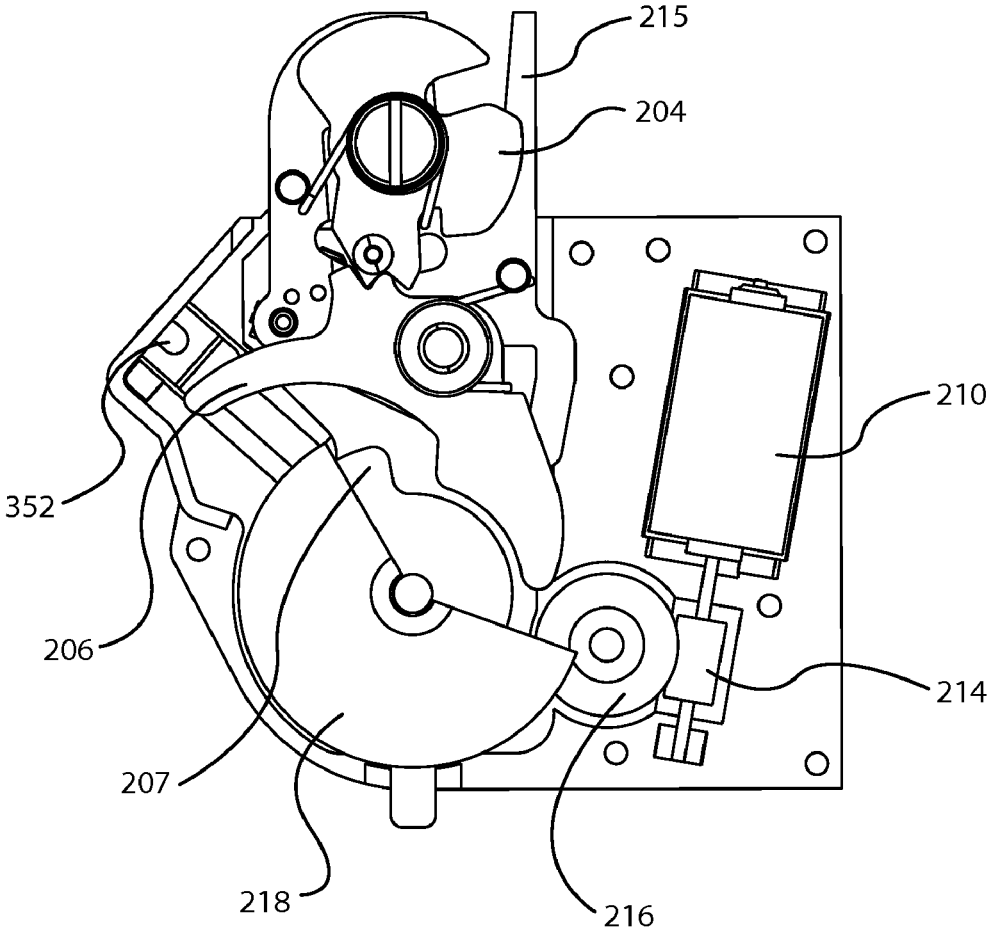
FIGS. 28-29 are views of the latch of the present invention showing the latch pawl in the second latched configuration relative to the support plate with portions of the housing removed.
Figure 29:
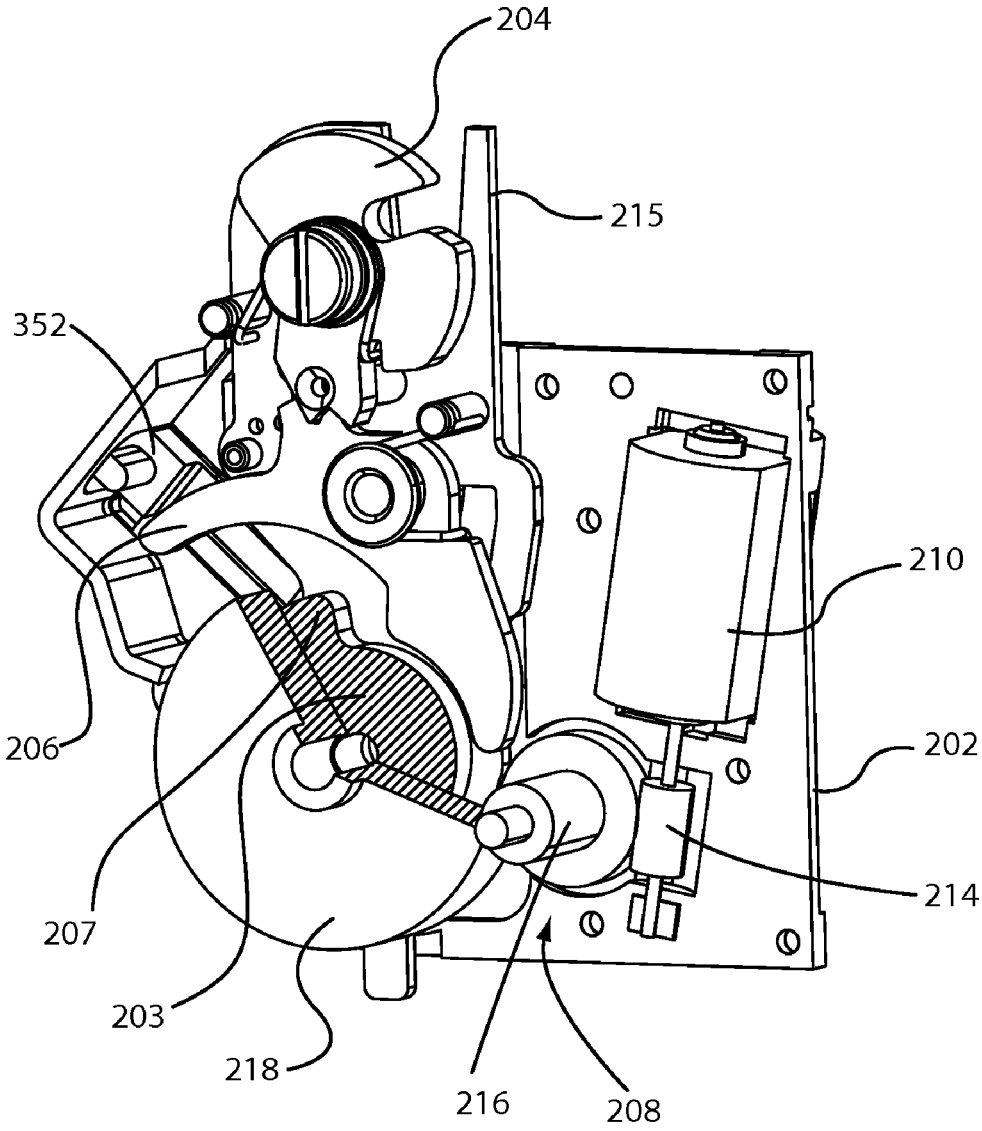
Figure 30:
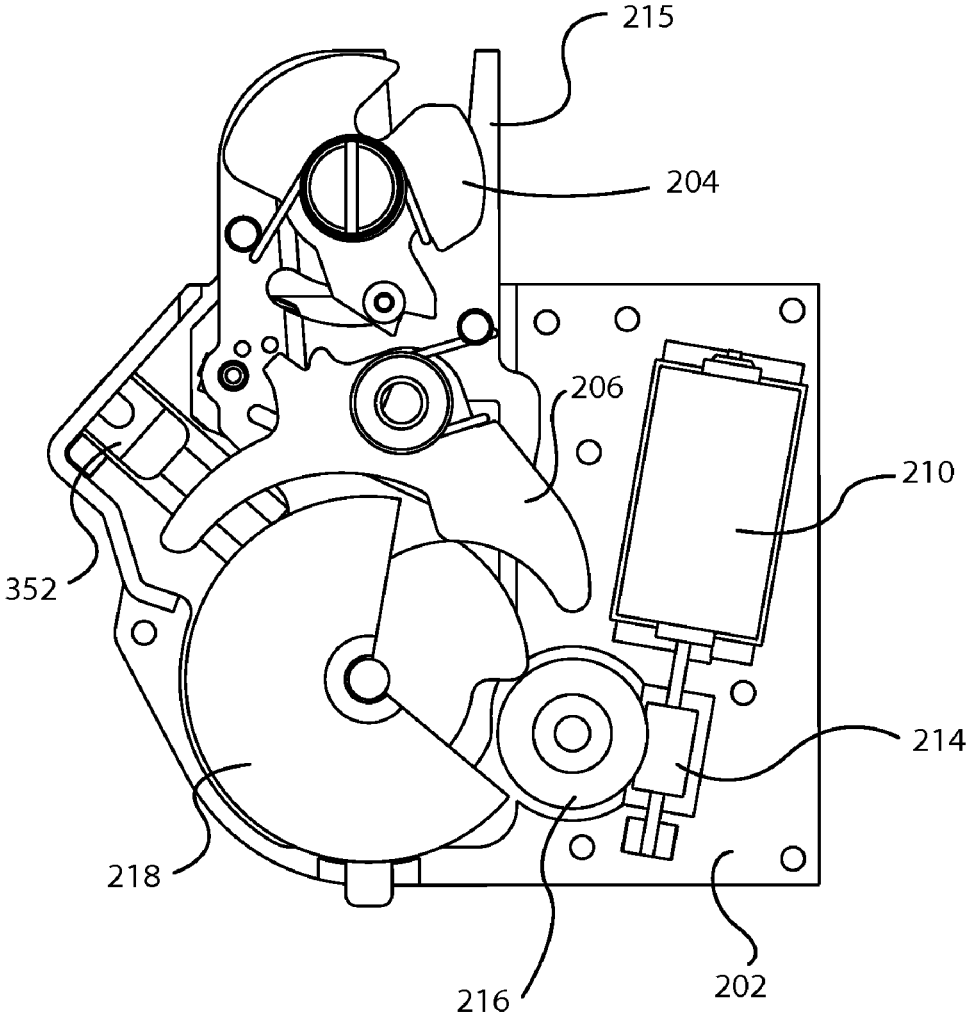
FIGS. 30-31 are views of the latch of the present invention showing the latch pawl in the open configuration relative to the support plate and the latch trigger actuated by the cam gear with portions of the housing removed.
Figure 31:
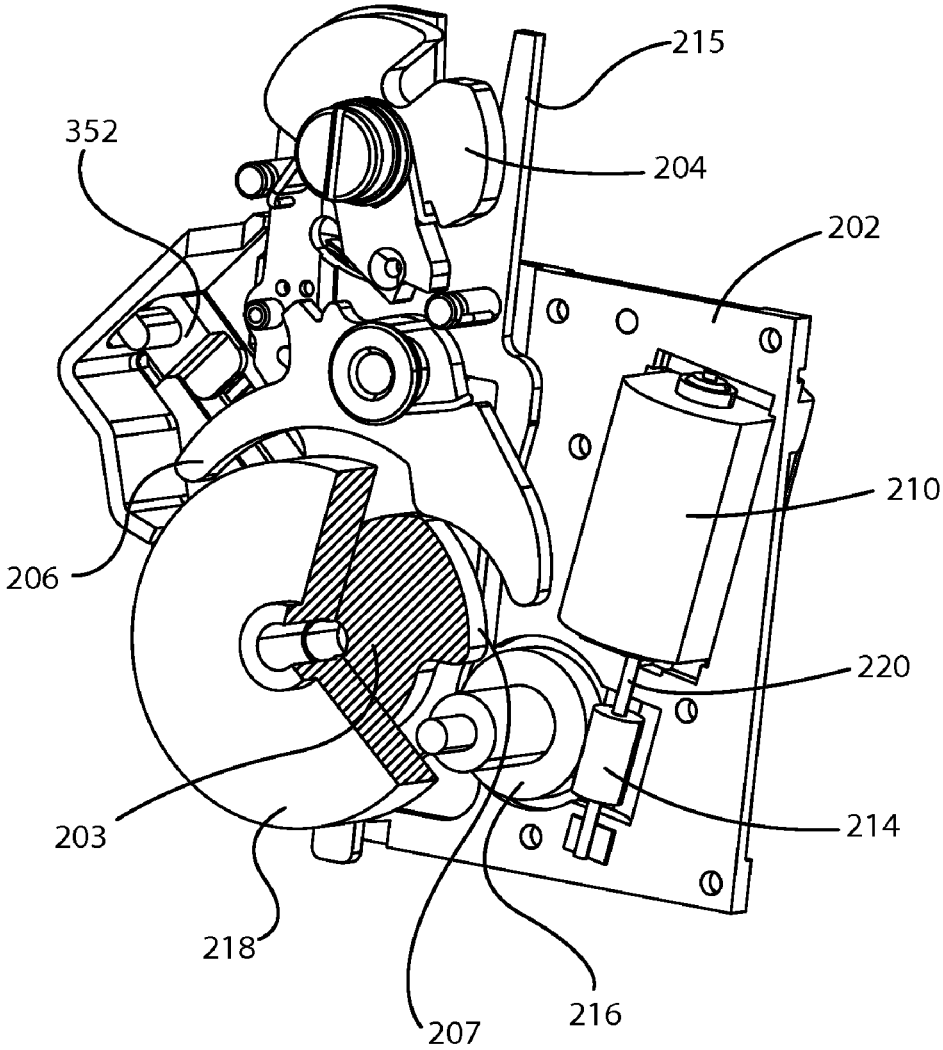
Figure 32:
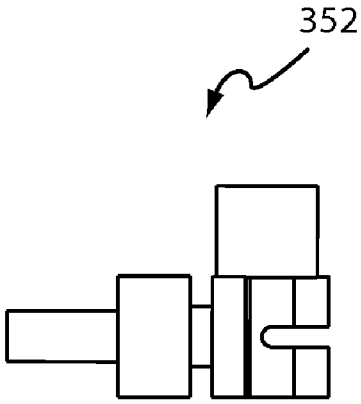
FIGS. 32-38 are views of the cable-actuated sliding block of the latch of the present invention.
Figure 35:
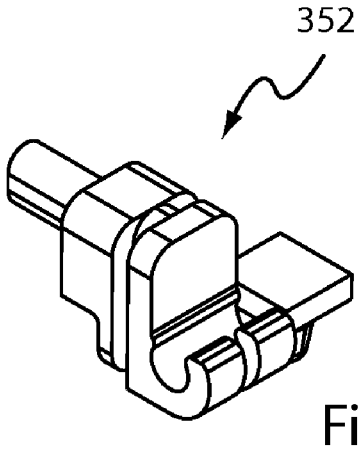
Figure 33:
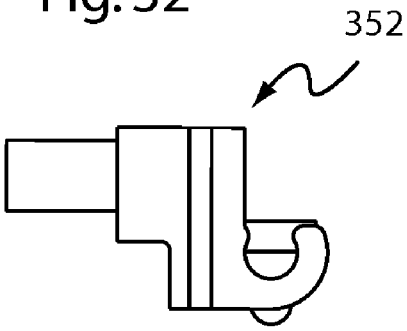
Figure 36:
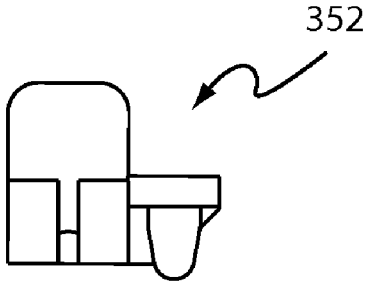
Figure 34:
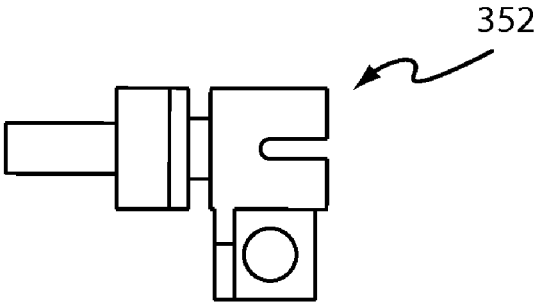
Figure 37:
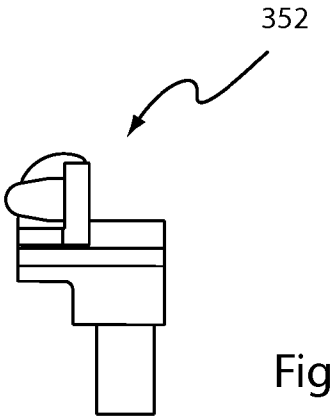
Figure 38:
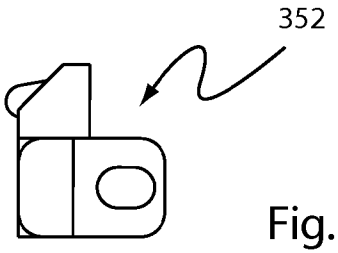
Figure 39:
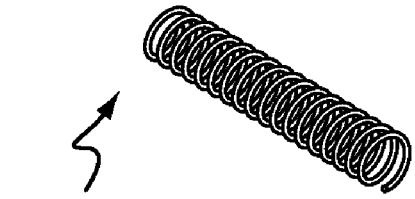
FIGS. 39-41 are views of the sliding block return spring of the latch of the present invention.
Figure 40:
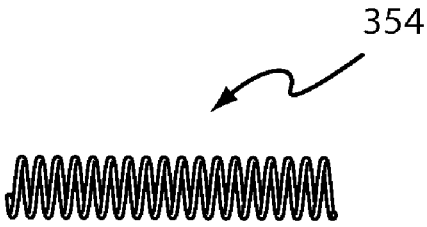
Figure 41:
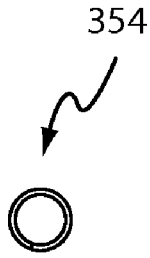
Figure 47:
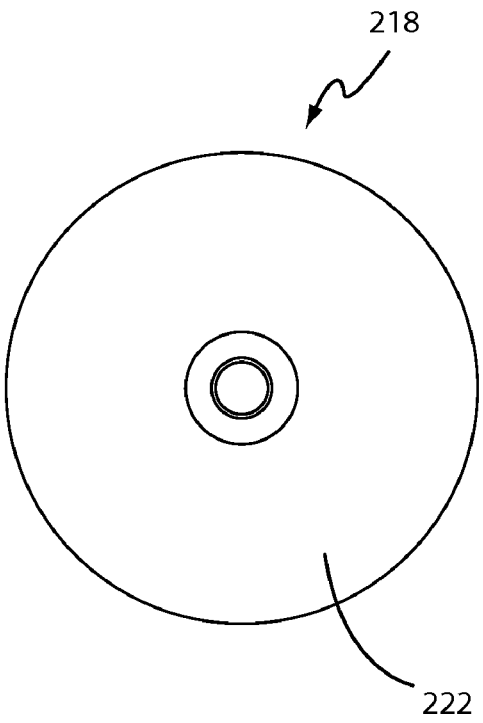
Figure 48:
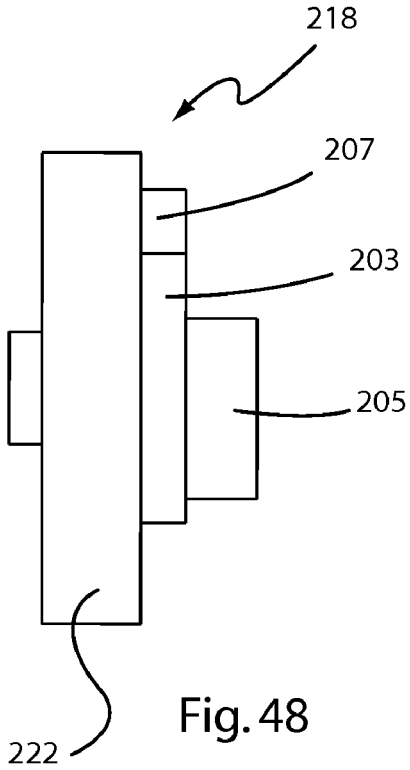
Figure 49:
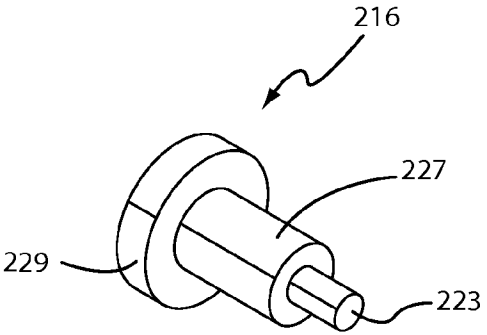
FIGS. 49-52 are views of the pinion gear of the latch of the present invention.
Figure 52:
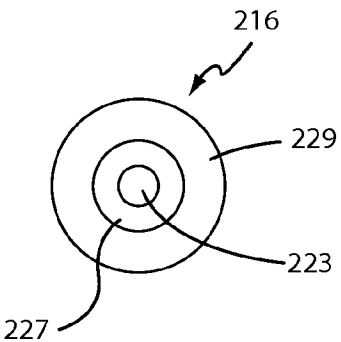
Figure 51:
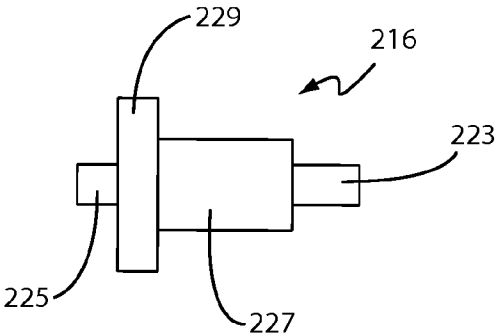
Figure 50:
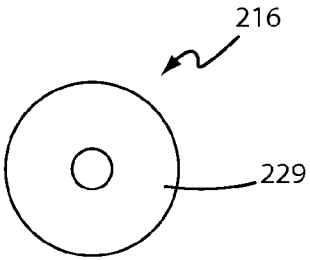
Figure 53:
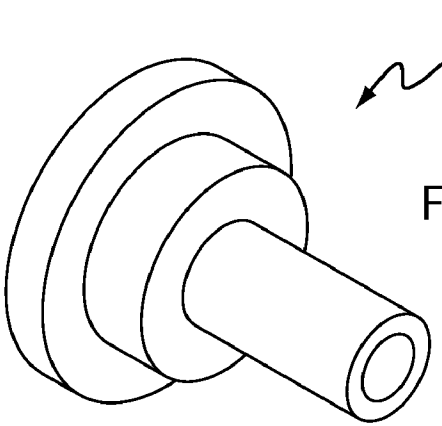
FIGS. 53-56 are views of the cam gear pin of the latch of the present invention.
Figure 55:
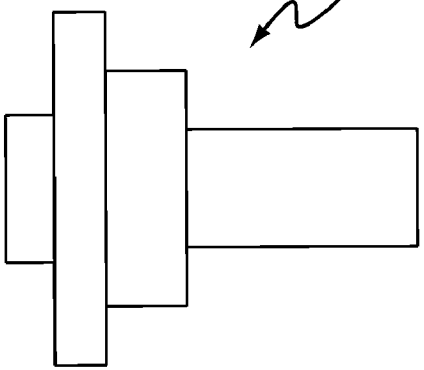
Figure 56:
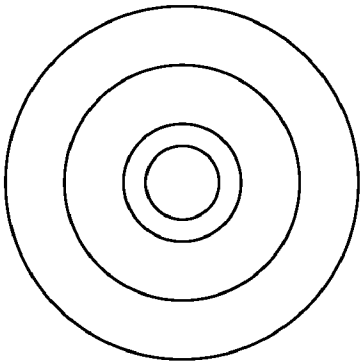
Figure 54:
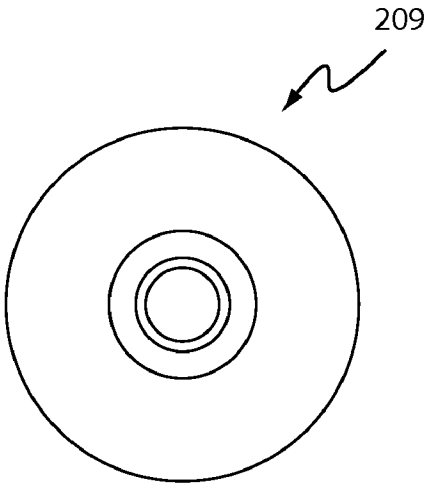
Figure 57:
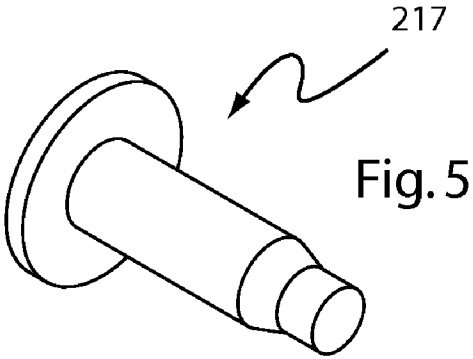
FIGS. 57-60 are views of the cam gear screw of the latch of the present invention.
Figure 60:
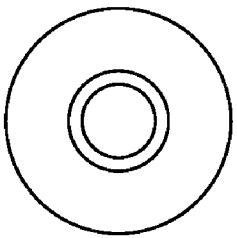
Figure 59:
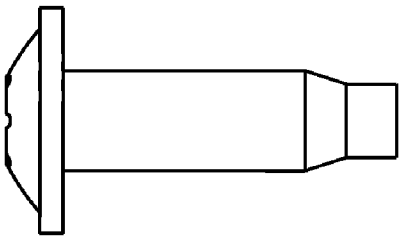
Figure 58:
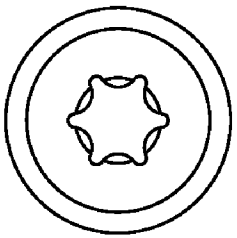
Figure 61:
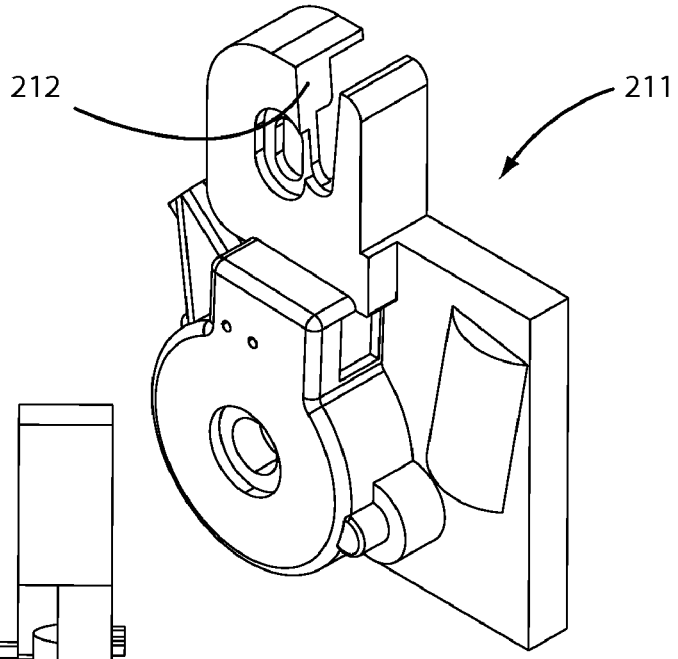
FIGS. 61-67 are views of the first portion of the housing of the latch of the present invention.
Figure 62:
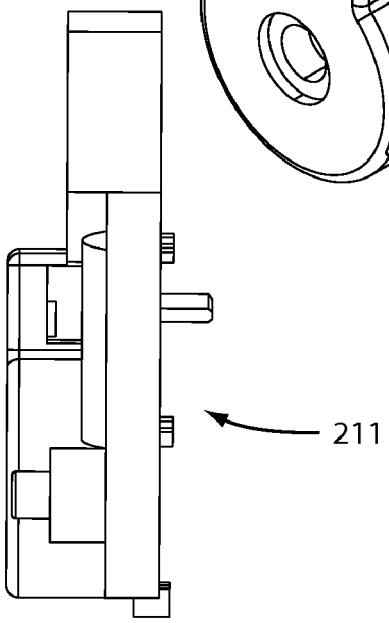
Figure 63:
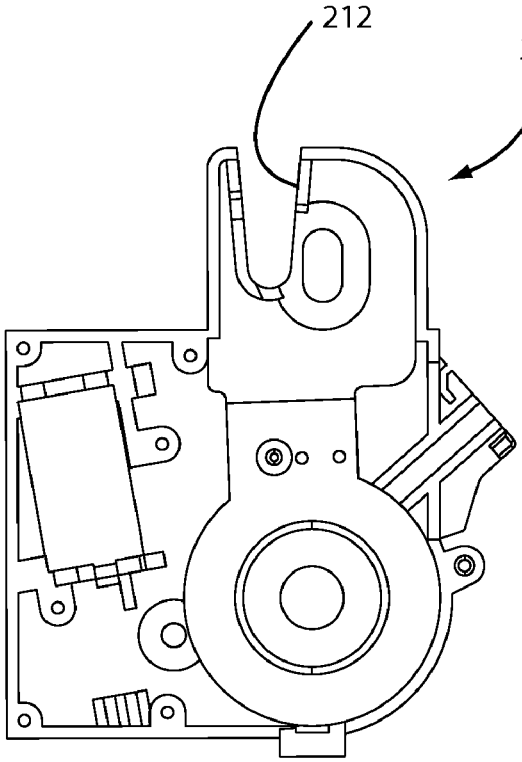
Figure 64:
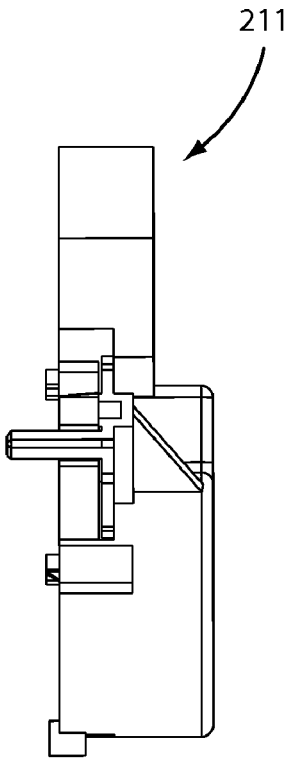
Figure 65:
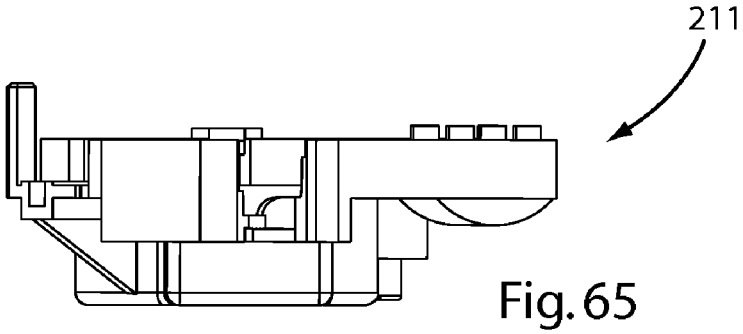
Figure 66:
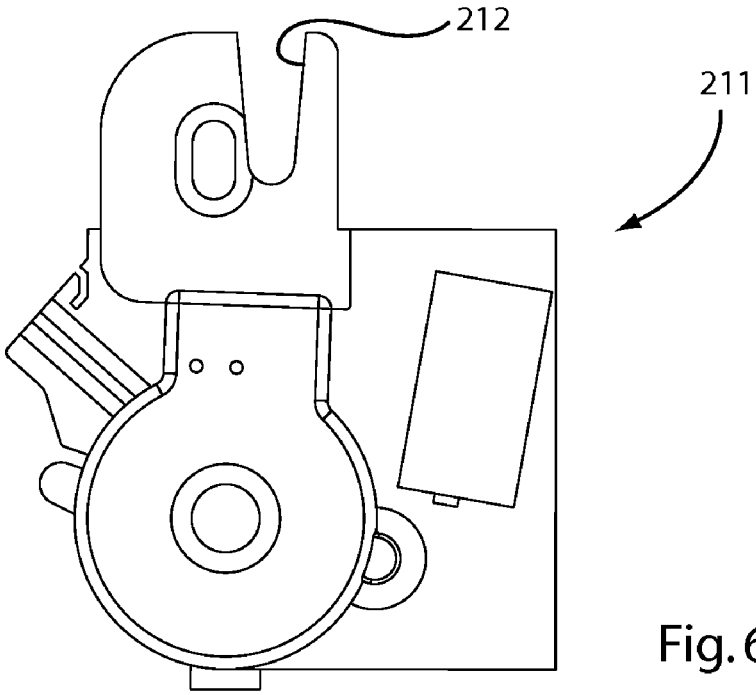
Figure 67:
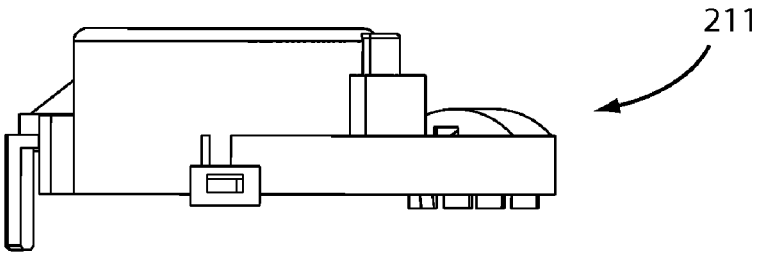
Figure 68:
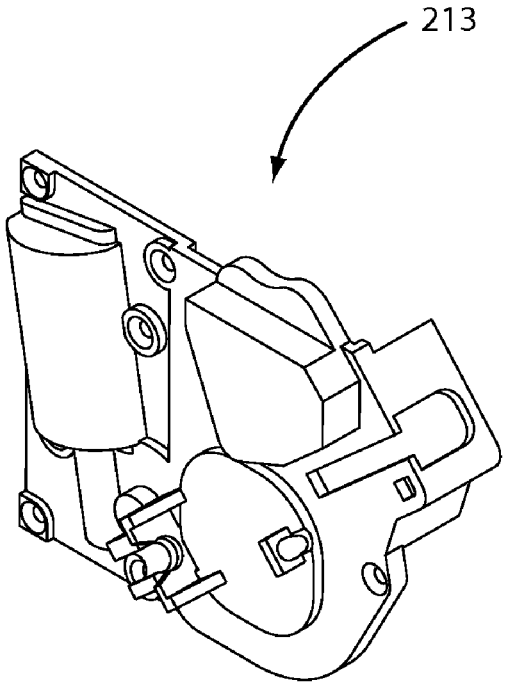
FIGS. 68-74 are views of the second portion of the housing of the latch of the present invention.
Figure 69:
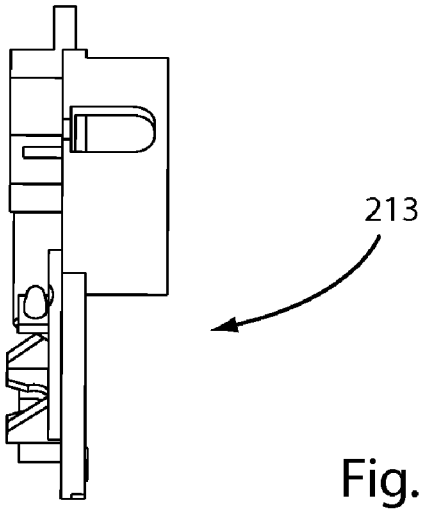
Figure 70:
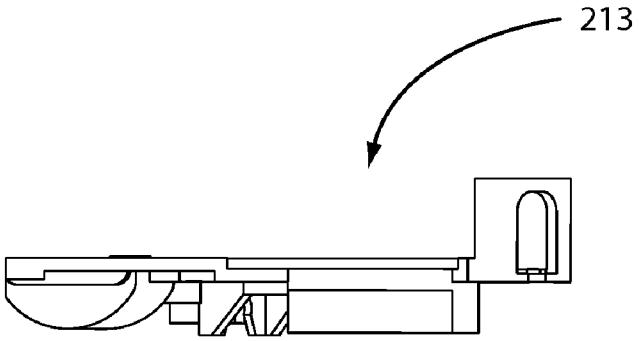
Figure 71:
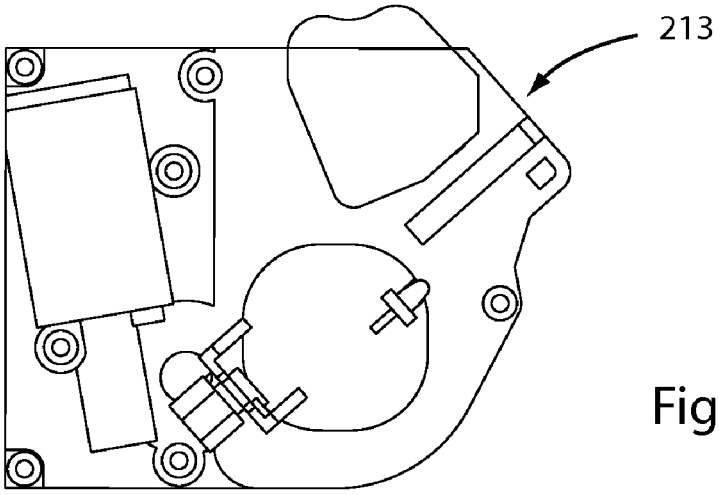
Figure 72:
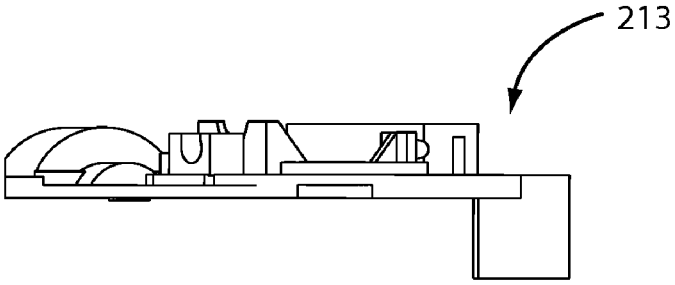
Figure 73:
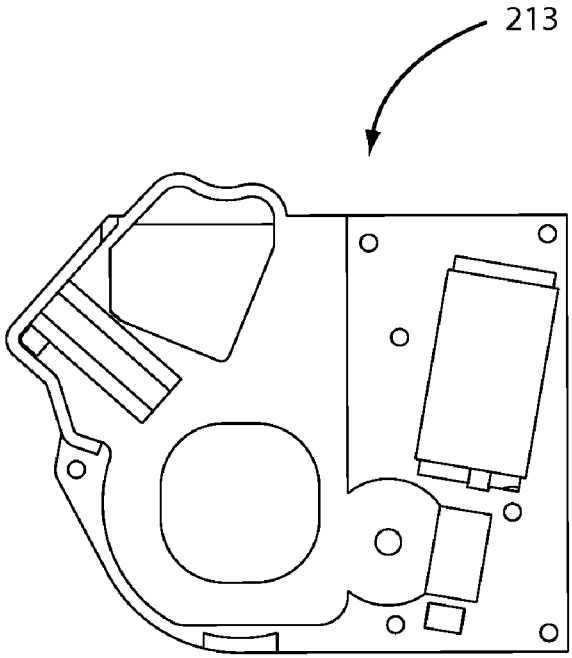
Figure 74:
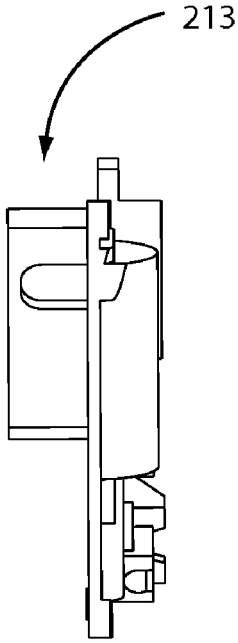
Figure 79:
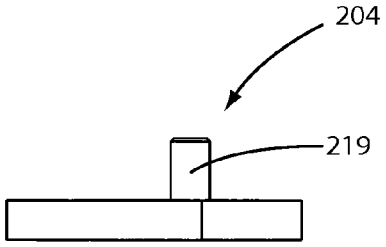
FIGS. 75-81 are views of the pawl of the latch of the present invention.
Figure 75:
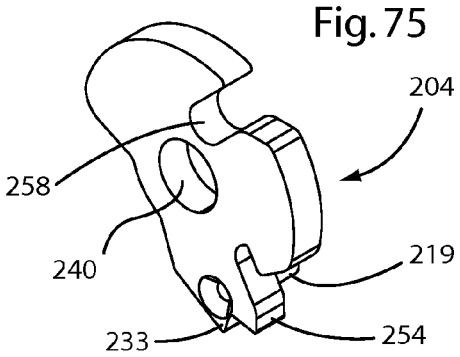
Figure 77:
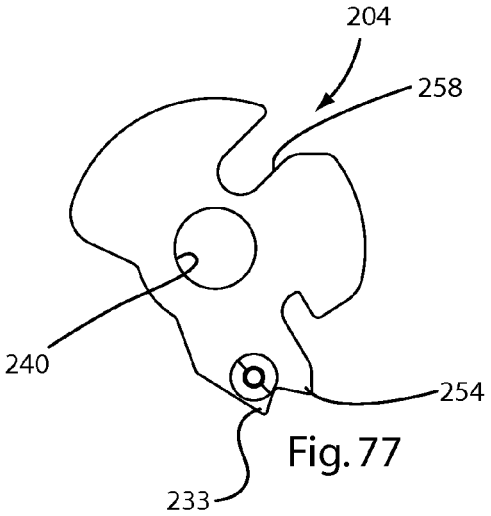
Figure 76:
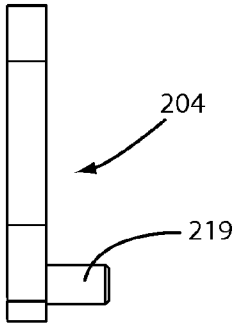
Figure 78:
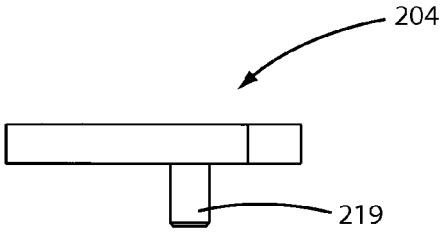
Figure 80:
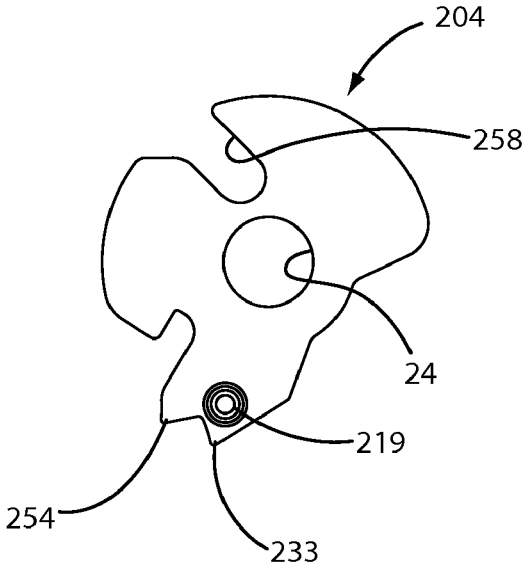
Figure 81:
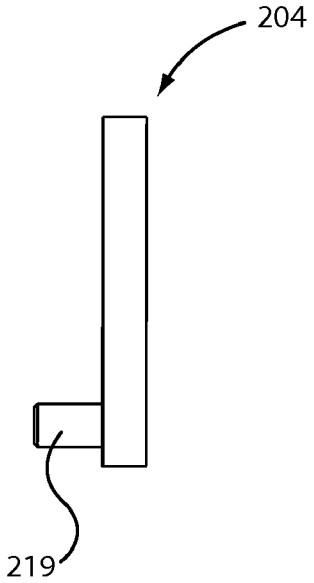
Figure 82:
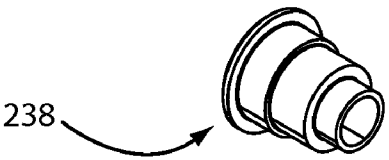
FIGS. 82-85 are views of the pawl pivot pin of the latch of the present invention.
Figure 85:
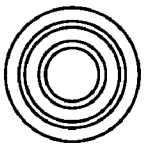
Figure 84:
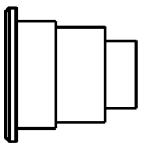
Figure 83:
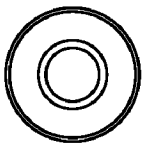
Figure 86:
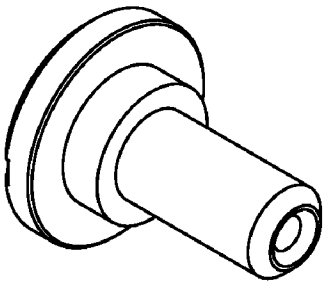
FIGS. 86-89 are views of the pawl pivot pin screw of the latch of the present invention.
Figure 89:
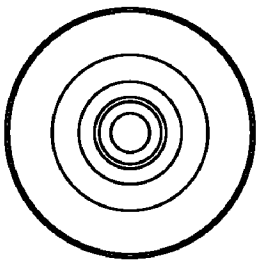
Figure 88:
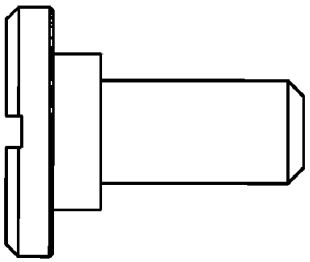
Figure 87:
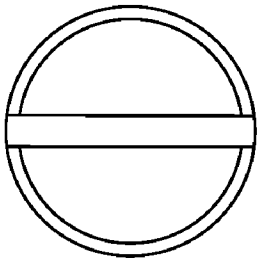
Figure 90:
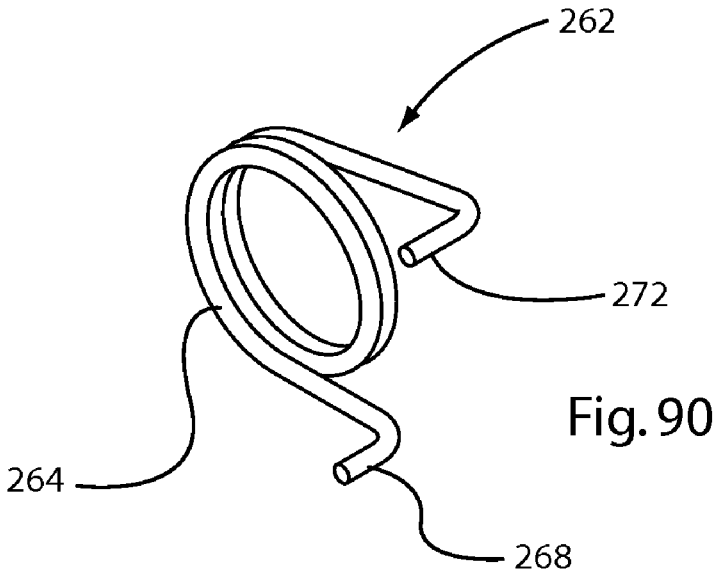
FIGS. 90-95 are views of the pawl torsion spring of the latch of the present invention.
Figure 91:
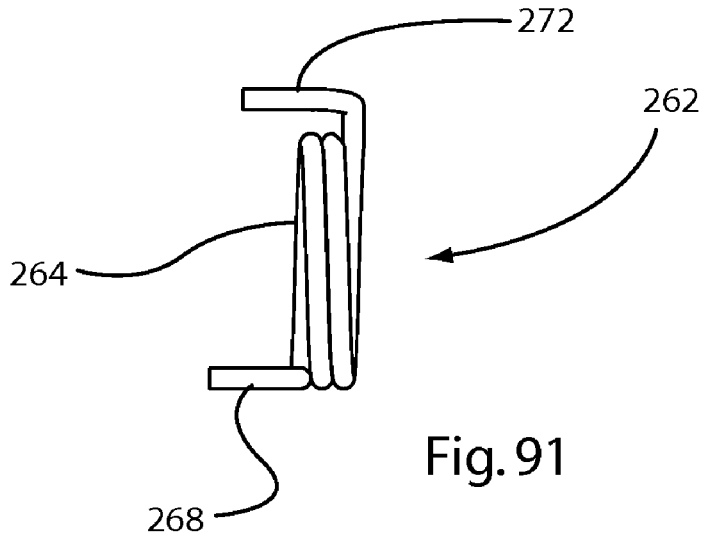
Figure 92:
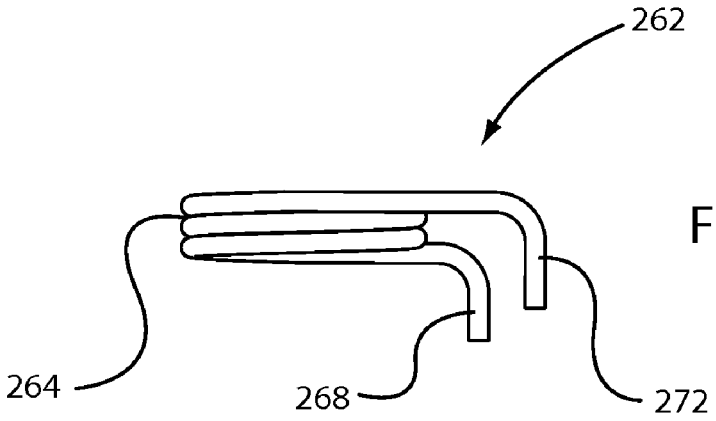
Figure 93:
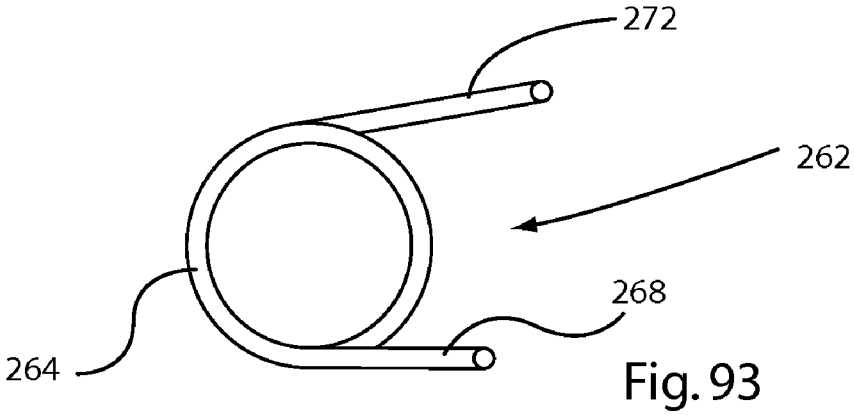
Figure 94:
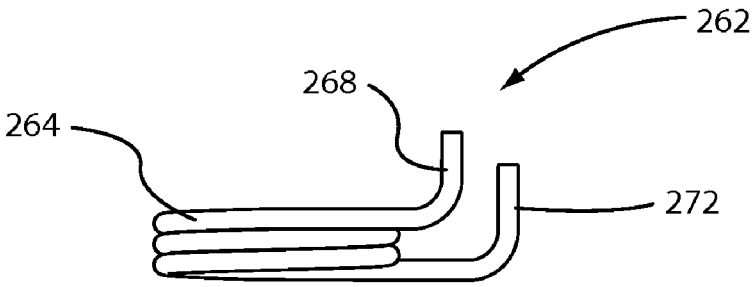
Figure 95:
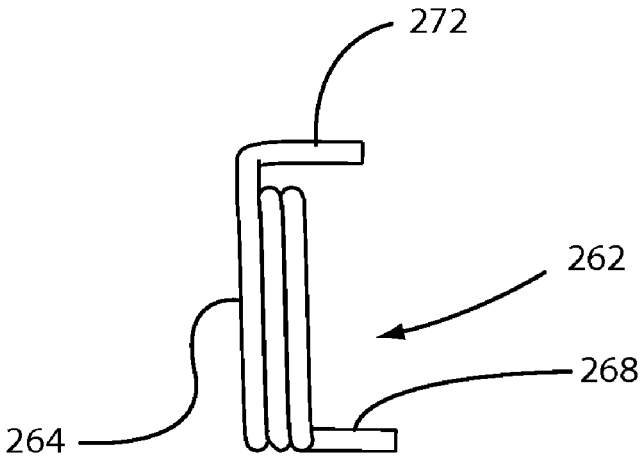
Figure 96:
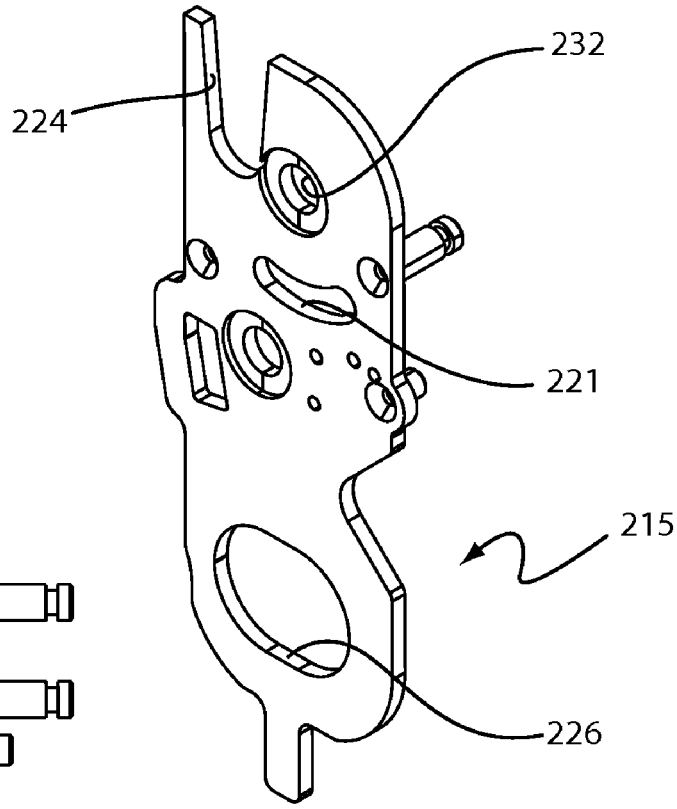
FIGS. 96-102 are views of the support plate of the latch of the present invention.
Figure 97:
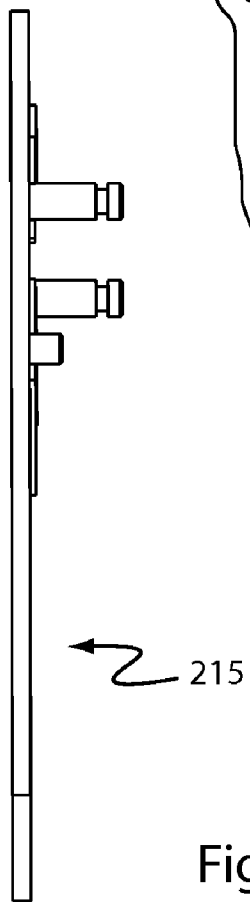
Figure 98:
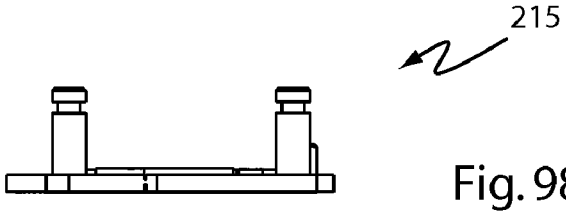
Figure 99:
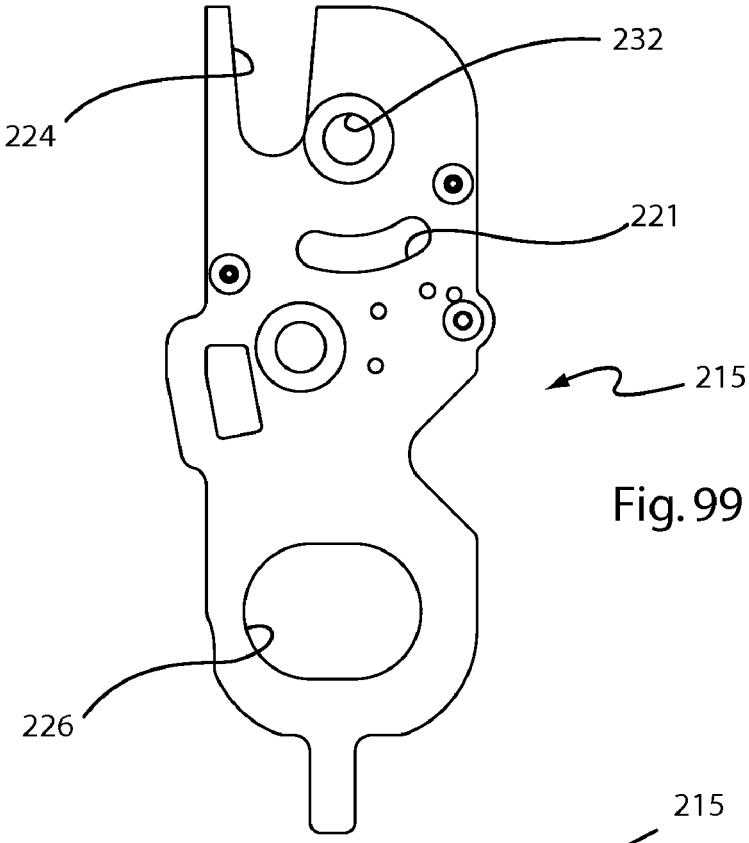
Figure 100:
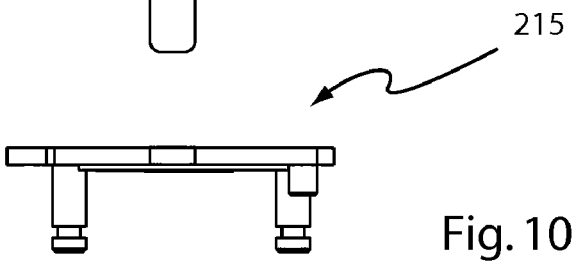
Figure 101:
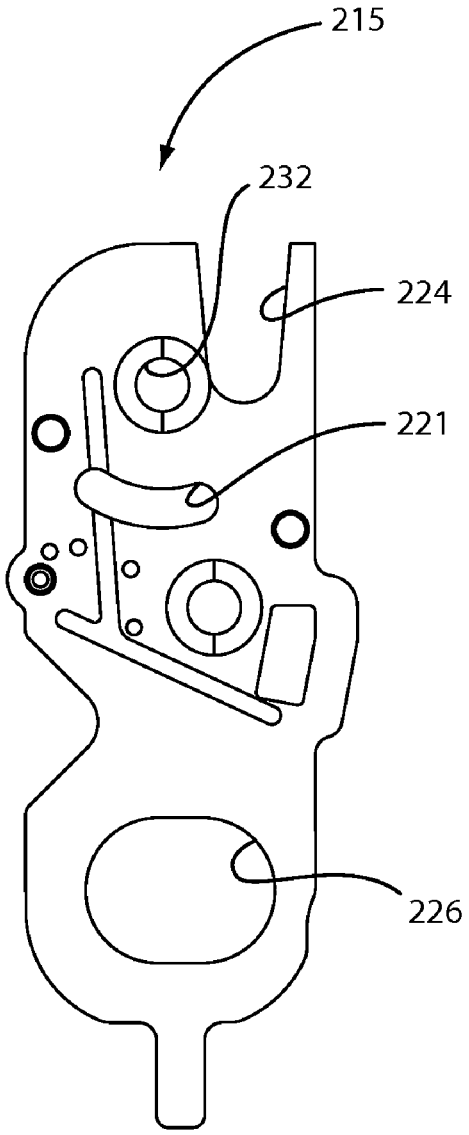
Figure 102:
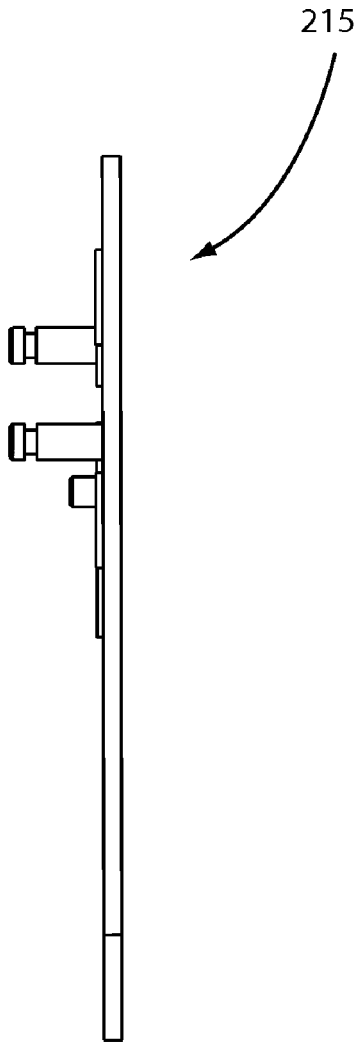
Figure 103:
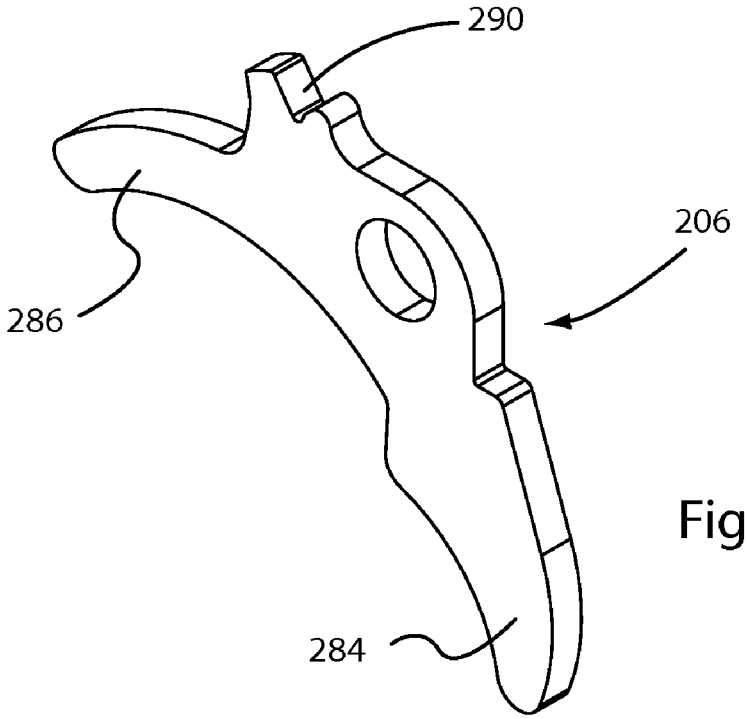
FIGS. 103-107 are views of the trigger of the latch of the present invention.
Figure 104:
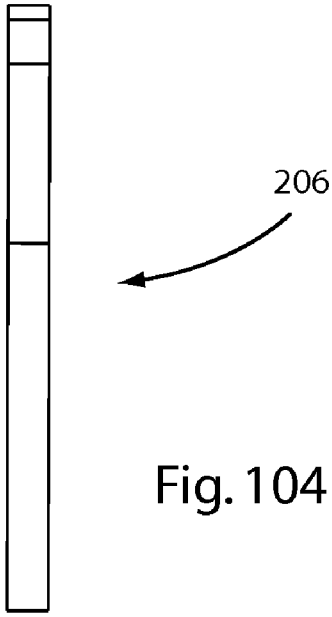
Figure 105:
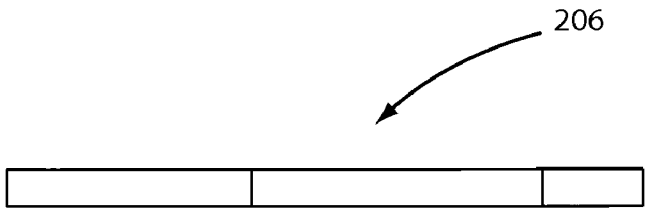
Figure 106:
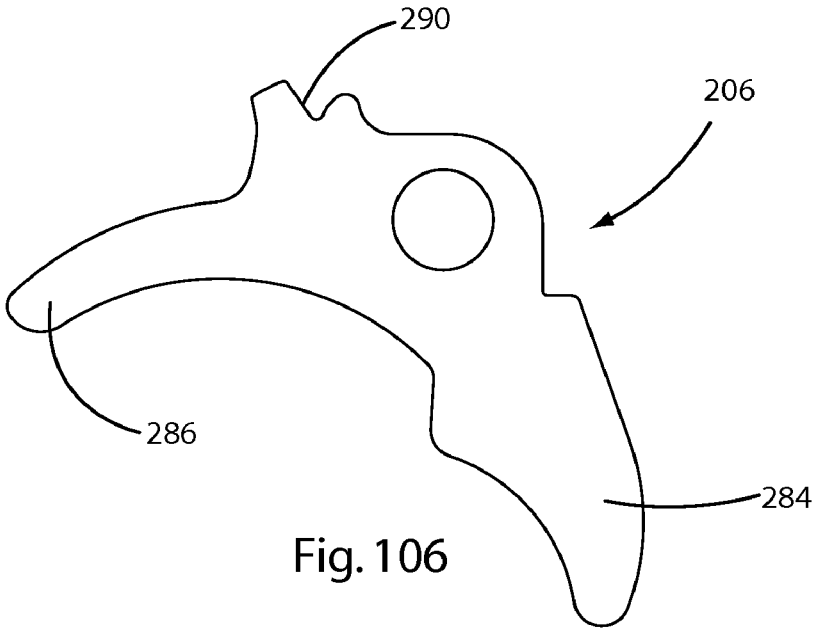
Figure 107:
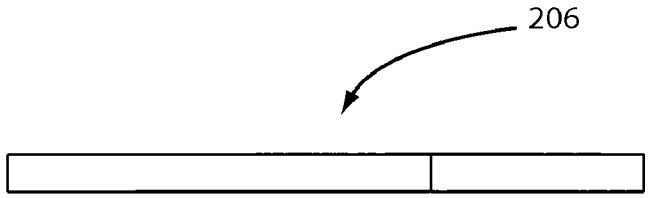
Figure 108:
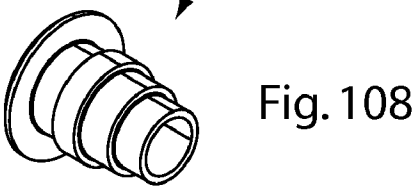
FIGS. 108-111 are views of the trigger pivot pin of the latch of the present invention.
Figure 111:
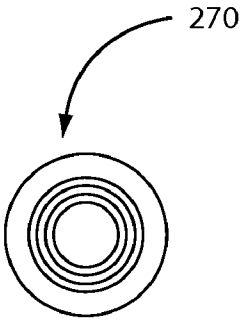
Figure 110:
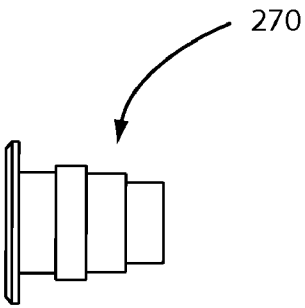
Figure 109:
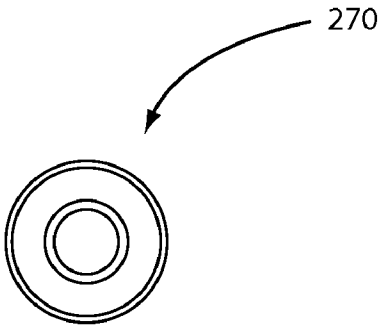
Figure 112:
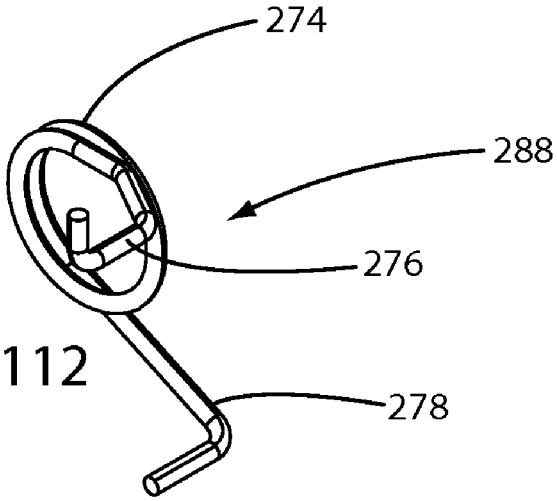
FIGS. 112-117 are views of the trigger spring of the latch of the present invention.
Figure 113:
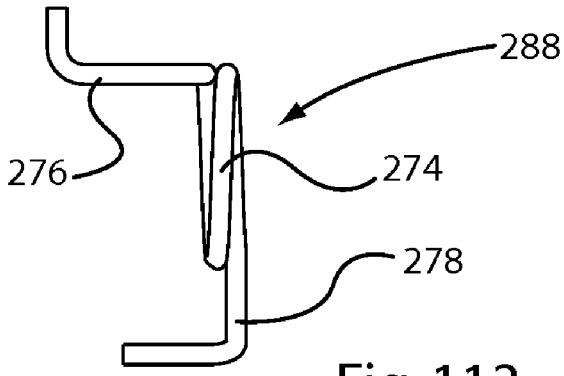
Figure 114:
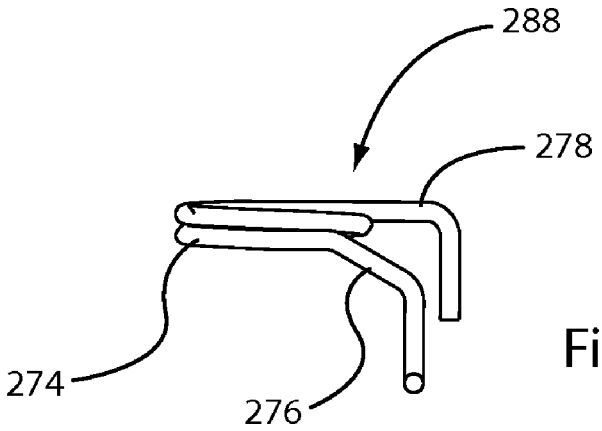
Figure 115:
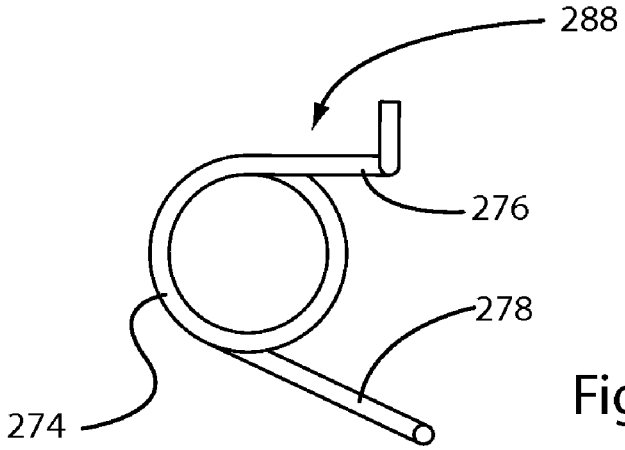
Figure 116:
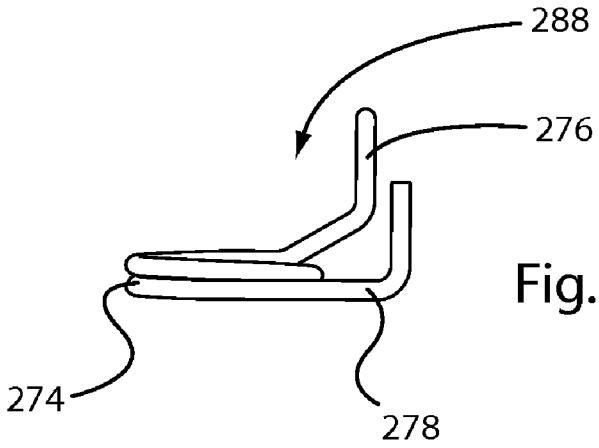

If the trunk lid 300 is closed on the inoperable latch 200, the striker 308 can engage and move the pawl 204 to the second latched position where the pawl 204 is held by the trigger 206 and the striker 308 is captured by the pawl slot 258. This second or back-up latched configuration is illustrated in FIGS. 28 and 29. This arrangement allows the trunk lid 300 to be secured in a near closed position until the vehicle can be taken in for service.

It is to be understood that the present invention is not limited to the embodiments disclosed above, but includes any and all embodiments within the scope of the appended claims.

The invention claimed is:

1. A latch (200) adapted for securing a closure member (300) in a predetermined position, the closure member being provided with a striker (308), the latch comprising:

a latch housing (202);

a pawl (204);

a trigger (206); and an electrically operated actuator assembly (208) capable of selectively moving said trigger (206) out of engagement with said pawl (204) and retracting said pawl inward relative to said housing (202), wherein the latch (200) is adapted for attachment to a second member such that the latch can be engaged by the striker (308) for securing the closure member (300) in the predetermined position relative to the second member, wherein said housing (202) has an opening that allows at least a portion of the striker (308) to enter said housing (202) for engagement by said pawl (204), and wherein the latch further comprises a support plate (215) supported for rectilinear movement relative to said housing (202), said opening is in the form of a slot (212) that passes through a first portion (211) of said housing (202), such that said slot (212) allows an unobstructed path for the striker (308) to engage said pawl (204) when said pawl is in an open configuration relative to said support plate (215), and said slot (212) is sized such that said housing (202) will not interfere with movement of the striker (308) relative to said housing (202) as said pawl (204) is moved from an open configuration to a closed configuration relative to said support plate (215) by contact with the striker (308) and as said pawl (204) is retracted inward relative to said housing (202) by said electrically operated actuator assembly (208).

2. A latch (200) adapted for securing a closure member (300) in a predetermined position, the closure member being provided with a striker (308), the latch comprising:

a latch housing (202);

a pawl (204);

a trigger (206); and an electrically operated actuator assembly (208) capable of selectively moving said trigger (206) out of engagement with said pawl (204) and retracting said pawl inward relative to said housing (202), wherein the latch (200) is capable of assuming a first latched configuration, a second latched configuration and an unlatched configuration, wherein said pawl (204) has first and second teeth (254, 233) provided for engagement by said trigger (206), and wherein said electrically operated actuator assembly (208) comprises:

a support plate (215) supported for rectilinear movement relative to said housing (202), said pawl (204) being pivotally supported by said support plate, said support plate (215) pivotally supporting said trigger (206), said support plate (215) having an elongated slot (226);

a cam gear (218) including a gear wheel (222), a first cam (203), and a second cam (205), said cam gear (218) being rotationally supported in said housing (202) for rotation about an axis of rotation, said first cam (203) having a cam lobe (207) located at a distance from said axis of rotation of said cam gear (218), said first cam (203) selectively tripping said trigger (206), said second cam (205) being eccentrically supported relative to said axis of rotation of said cam gear (218), said elongated slot (226) of said support plate being engaged by said second cam (205) of said cam gear (218), such that rotation of said cam gear (218) causes rectilinear movement of said support plate (215) relative to said housing (202);

a motor (210) selectively powering rotation of said cam gear; and a sensor (332) mounted on said support plate (215);

wherein said pawl (204) is provided with a pawl slot (258) to capture and hold the striker (308) when said pawl (204) is in either one of a first latched position and a second latched position relative to said support plate (215), wherein with the latch (200) initially in said unlatched configuration, as the closure member (300) is closed, the striker (308) will be positioned and captured in said pawl slot (258) with said pawl (204) being moved to said first latched position relative to said support plate (215), wherein said sensor (332) is tripped when said pawl (204) reaches said first latched position, when said sensor (332) is tripped a signal is generated that causes electrical current to be supplied to said motor (210) to thereby cause rotation of said cam gear (218) to a latched position corresponding to said first latched configuration in order to move said support plate (215) and said pawl (204) to a retracted position corresponding to said first latched configuration relative to the housing (202).

3. The latch according to claim 2, further comprising:

a second sensor (231) supported by said housing (202) that senses when said cam gear (218) is in a position corresponding to said latched configuration and upon sensing such a condition generates a signal to shut off electrical current to said motor (210).

4. A method for operating the latch of claim 3, wherein the electrical current supplied to the motor (210) has a polarity, the method comprising the steps of:

providing a control circuit for controlling the electrical current to the motor (210); and reversing the polarity of the electrical current supplied to the motor (210) to rotate the cam gear (218) in a reverse direction when the second sensor (231) fails to signal that the cam gear (218) has reached the position corresponding to the latched configuration after a predetermined interval of time.

5. The latch according to claim 3, wherein said trigger (206) has a notch (290) that receives and engages said the first tooth (254) of said pawl (204) to hold or retain said pawl (204) in said first latched position relative to said support plate (215), and wherein said notch (290) of said trigger (206) receives and engages said second tooth (233) of said pawl (204) to hold or retain said pawl (204) in said second latched position relative to said support plate (215) when said striker (308) moves said pawl (204) to said second latched position with said support plate (215) in a retracted position relative to said housing (202).

6. The latch according to claim 5, further comprising:

a sliding block (352) that is supported for rectilinear movement by said housing (202), said sliding block being capable of selectively engaging said trigger (206) to disengage said trigger from said pawl (204) to thereby release said pawl; and a Bowden cable (350) connected to said sliding block such that said pawl 204 is released when said Bowden cable is pulled.

7. The latch according to claim 6, wherein said trigger (206) has a first lever arm (284) and a second lever arm (286) that extend approximately along an arc on either side of a pivot axis of said trigger (206), said first lever arm being adapted for engagement by the cam lobe (207) and said second lever arm being adapted for engagement by said sliding block (352).

* * * * *